US007327968B2

(12) United States Patent
Hosoi

(10) Patent No.: US 7,327,968 B2
(45) Date of Patent: Feb. 5, 2008

(54) IMAGE FORMING SYSTEM, IMAGE FORMING APPARATUS, AND IMAGE PROCESSING APPARATUS

(75) Inventor: Hideaki Hosoi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 322 days.

(21) Appl. No.: 11/222,174

(22) Filed: Sep. 8, 2005

(65) Prior Publication Data

US 2006/0056872 A1 Mar. 16, 2006

(30) Foreign Application Priority Data

Sep. 14, 2004 (JP) ..... 2004-267538

(51) Int. Cl.
*G03G 15/00* (2006.01)

(52) U.S. Cl. ..... 399/81; 399/85; 399/87

(58) Field of Classification Search ..... 399/75, 399/81, 82, 85, 87
See application file for complete search history.

(56) References Cited

U.S. PATENT DOCUMENTS 4,572,652 A * 2/1986 Tada et al. ..... 399/81

6,411,787 B1 * 6/2002 Frederiksen et al. ..... 399/81

FOREIGN PATENT DOCUMENTS

JP 08-297388 A 11/1996

* cited by examiner

*Primary Examiner*—Hoan Tran
(74) *Attorney, Agent, or Firm*—Akin Gump Strauss Hauer & Feld LLP

(57) ABSTRACT

To provide an image forming system capable of displaying appropriately a plurality of apparatus statuses at low cost, the image forming system is structured upon connection of an independently operable printing apparatus with an independently operable scanning apparatus. The scanning apparatus stores in an NVRAM a status message of the printing apparatus corresponding to operable level information of the printing apparatus and displays the appropriate status message on a display unit upon selection among the plurality of status messages for indicating status of the printing apparatus based on the operable level information retrieved from the printing apparatus based on control by a main controller.

14 Claims, 16 Drawing Sheets

FIG. 15

PLEASE SELECT PRINTER STATUS MESSAGE UPDATING MODE

1.IMMEDIATE INTERRUPTION MODE
2. INTERRUPTION WITH PREDETERMIND WAITING TIME

FIG. 16

PLEASE SELECT SCANNER STATUS MESSAGE UPDATING MODE

1.IMMEDIATE INTERRUPTION MODE
2. INTERRUPTION WITH PREDETERMIND WAITING TIME

| PRINTER STATUS MESSAGE | FUSER ERROR | NO TONER | NO RECORDING SHEET | RECORDING SHEET JAM | . . . | TONER IS RUNINNG OUT SOON |
|---|---|---|---|---|---|---|
| UPDATING TIME INTERVAL(S) | 0 | 2 | 5 | 6 | . . . | 10 |

FIG. 19

| SCANNER STATUS MESSAGE | LAMP ERROR | ORIGINAL DOCUMENT JAM | COVER OPEN | WARMING-UP | . . . |
|---|---|---|---|---|---|
| UPDATING TIME INTERVAL(S) | 0 | 3 | 4 | 6 | . . . |

IMAGE FORMING SYSTEM, IMAGE FORMING APPARATUS, AND IMAGE PROCESSING APPARATUS

BACKGROUND OF THE INVENTION

1. Field of the Invention

This invention relates to an image forming system and an image forming apparatus combined with a function of reading optically an image on an original document and a function of forming the image on a recording medium. Furthermore, this invention relates to an image forming apparatus having a function of forming the image on the predetermined recording medium and to an image processing apparatus having a function of reading optically the image on the original document.

2. Description of Related Art

An image forming apparatus for realizing a photocopying function in addition to a scanning function and a printing function has been conventionally built up upon a combination of a host computer, a scanning apparatus for reading optically an image, and a printing apparatus for forming the image on a recording medium. Such an image forming system has been proposed with a display unit for indicating each of statuses of the scanning apparatus and the printing apparatus (see, e.g., Japanese Patent Application Publication No. H08-297,388).

More specifically, the above mentioned Japanese Patent Application Publication No. H08-297,388 discloses the image forming apparatus having a scanning unit for reading optically the image on an original document, a printing unit for forming the image on a recording sheet, and a controller for controlling those scanning unit and printing unit. Particularly in this image forming apparatus, the printing unit and the scanning unit are respectively contained in two separated housings. The scanning unit is arranged with an operation display section for displaying errors and statuses of the scanning unit and the printing unit and for inputting operation of the entire image forming apparatus. The printing unit is arranged with a display section for displaying errors and statuses of the printing unit. With the image forming apparatus of this type, consequently, the unit thus subjecting to the error or status can be easily detected, thereby being able to improve usage.

The image forming apparatus provided with display sections respectively for indicating statuses of the scanning apparatus and the printing apparatus, however, raises a problem that the image forming apparatus cannot be used easily because requiring to confirm the operational status of both the scanning apparatus and the printing apparatus using respective display units when the user wants to use the copying function.

To solve the above problem, an image forming system has been proposed lately in which a scanning apparatus retrieves a status of a printing apparatus to display not only the status of itself but also the status of the printing apparatus on a display unit of the scanning apparatus.

With such the conventional image forming system displaying the status information of the printing apparatus on the display unit of the scanning apparatus, however, the display unit of the scanning apparatus needs to have a display region capable of displaying various statuses of the printing apparatus in addition to a display region for displaying statuses of the scanning apparatus. Therefore, there has been problems with this image forming system, such that the display unit of the scanning apparatus becomes larger in size or requires a complicated structure for displaying pictorial symbols such as, e.g., icon or the like, thereby highly increasing costs.

This invention has been invented in consideration of the above backgrounds, and it is an object of the invention to provide an image forming system and an image forming apparatus capable of displaying appropriately a plurality of apparatus statuses at a low cost. It is another object of this invention to provide an image forming apparatus and an image processing apparatus used for such an image forming system.

SUMMARY OF THE INVENTION

To achieve the above described objects, an image forming system according to this invention includes an image processing apparatus having a function of reading optically an image on an original document, and an image forming apparatus having a function of forming an image on a predetermined recording medium. The image forming apparatus comprises a first display section for displaying image forming status information data indicating a status of the image forming apparatus, a first storage section for storing corresponding to each other the plurality of image forming status information data and operable level information used for selecting the image forming status information to be displayed on the first display section among the plurality of image forming status information data, a first interface for connecting the image forming apparatus to the image processing apparatus, an image forming section for forming image data received from the image processing apparatus through the first interface section on the recording medium, and a first controller for selecting, based on the status of the image forming apparatus and the operable level information stored in the first storage section, the image forming status information data to be displayed on the first display section among the plurality of image forming status information data stored in the first storage section. The image processing apparatus comprises a second display section for displaying image processing status information data indicating a status of the image processing apparatus, a second storage section for storing corresponding to each other the plurality of image processing status information data and the operable level information used for selecting the image processing status information data to be displayed on the second display section among the plurality of image processing status information data, a third storage section for storing the image forming status information data corresponding to the operable level information of the image forming apparatus, a third display section for displaying the image forming status information data stored in the third storage section, a second interface section for connecting the image processing apparatus to the image forming apparatus, an image reading section for reading the image and for transmitting retrieved image data to the image forming apparatus through the second interface section, an operable level information retrieving section for retrieving the operable level information of the image forming apparatus, and a second controller for selecting based on the status of the image processing apparatus and the operable level information stored in the second storage section the image processing status information data to be displayed on the second display section among the plurality image processing status information data stored in the second storage section, and for selecting based on the operable level information of the image forming apparatus retrieved with the operable level information retrieving section the image forming status information data to be displayed on the third display section among the plurality of image forming status information data stored in the third storage section.

With the image forming system according to this invention, the user can make a judgment very easily as to whether the functions combined with those image processing apparatus and image forming apparatus are available or not with a simple structure at low cost since the display section of the image processing apparatus displays based on the operable level information the status information data on the image forming apparatus defined as the other apparatus connected to the image processing apparatus in addition to the status information data on the image processing apparatus.

Herein, the operable level information includes a parameter for indicating order of priorities in reporting to the user about the plurality of statuses caused in at least one of the image forming apparatus and the image processing apparatus. The operable level information preferably includes a parameter for indicating as to whether the function of at least one of the image forming apparatus and the image processing apparatus is available or not at the event of the corresponding status.

Furthermore, the third display section desirably displays image forming status information data indicating as to whether at least the function of the image forming apparatus is available or not. Consequently, the cost reduction can be intended with the image forming system according to this invention, since it is unnecessary to form to the image processing apparatus the display region for displaying all the status information data of the image forming apparatus, to store in the image processing apparatus all the status information data displayed on the display section of the image forming apparatus, nor to complicate the structure to display the pictorial symbols such as, e.g., icons or the like, corresponding to the statuses.

It is to be noted that each of the image forming apparatus and the image processing apparatus is formed as a separated apparatus such as operable independently.

To achieve the above described objects, the image processing apparatus according to this invention having a function of reading optically an image on an original document comprises a first display section for displaying image processing status information data indicating a status of the image processing apparatus, a first storage section for storing corresponding to each other the plurality of image processing status information data and operable level information used for selecting the image processing status information data to be displayed on the first display section among the plurality of image processing status information data, an interface section for connecting the image processing apparatus to an image forming apparatus having a function of forming an image on a predetermined recording medium, an image reading section for reading the image and for transmitting retrieved image data to the image forming apparatus through the interface section, a second storage section for storing image forming status information data corresponding to the operable level information used for selecting the image forming status information data to be displayed on a display section of the image forming system among the plurality of image forming status information data indicating the status of the image forming apparatus connected through the interface section, a second display section for displaying the image forming status information data stored in the second storage section, an operable level information retrieving section for retrieving the operable level information of the image forming apparatus, and a controller for selecting, based on the status of the image processing apparatus and the operable level information stored in the first storage section, the image processing status information data to be displayed on the first display section among the plurality of image processing status information data stored the first storage section and for selecting, based on the operable level information of the image forming apparatus retrieved with the operable level information retrieving section, the image forming status information data to be displayed on the second display section among the plurality of image forming status information data stored in the second storage section.

With the image processing apparatus according to this invention, the user can make a judgment very easily as to whether the functions combined with those image processing apparatus and image forming apparatus are available or not with a simple structure at low cost since the display section of the image processing apparatus displays the status information data on the image forming apparatus defined as the other apparatus connected to the image processing apparatus in addition to the status information data on the image processing apparatus itself based on the operable level information.

Furthermore, to achieve the above described objects, the image forming system according to this invention includes an image processing apparatus having a function of reading optically an image on an original document, and an image forming apparatus having a function of forming the image on a predetermined recording medium. The image forming apparatus comprises a first display section for displaying image forming status information data indicating a status of the image forming apparatus, a first storage section for storing corresponding to each other the plurality of image forming status information data and operable level information used for selecting the image forming status information data to be displayed on the first display section among the plurality of image forming status information data, a second storage section for storing corresponding to each other a plurality of image processing status information data indicating a status of the image processing apparatus and the operable level information used for selecting among the plurality of image processing status information data the image processing status information data to be displayed on a display section of the image processing apparatus, a third storage section for storing the image forming status information data corresponding to the operable level information of the image forming apparatus, a first interface section for connecting the image forming apparatus to the image processing apparatus, an image forming section for forming on the recording medium image data received from the image processing apparatus through the first interface section, an image processing apparatus status retrieving section for retrieving the status of the image processing apparatus from the image processing apparatus through the first interface section, and a controller for selecting, based on the status of the image forming apparatus and the operable level information stored in the first storage section, the image forming status information data to be displayed on a first display section among the plurality of image forming status information data stored in the first storage section. The image processing apparatus comprises a second display section for displaying the image processing status information data indicating the status of the image processing apparatus, a second interface section for connecting the image processing apparatus to the image forming apparatus, an image reading section for reading the image and for transmitting retrieved image data to the image forming apparatus through the second interface section, and a third display section for displaying the image forming status information data stored in the third storage section, wherein the controller selects, based on the status of the image processing apparatus retrieved with the image processing apparatus status retrieving section and the operable level information stored in the second storage section, the image processing status information data to be displayed on the second display section among the plurality of image processing status information data stored in the second storage section, and selects, based on the operable level information stored in the first storage section, the image forming status information data to be displayed on the third display section among the plurality of image forming status information data stored in a third storage section.

With the image forming system according to this invention, the user can make a judgment very easily as to whether the functions combined with those image processing apparatus and image forming apparatus are available or not with a simple structure at low cost since the display section of the image processing apparatus defined the other apparatus connected to the image forming apparatus displays the status information data on the image forming apparatus in addition to the status information data on the image processing apparatus based on operable level information.

It is to be noted that the above described image processing apparatus is formed as the independently inoperable apparatus connected in a detachably attachable manner to the independently operable image forming apparatus.

Furthermore, to achieve the above described objects, the image forming apparatus according to this invention having a function of forming an image on a predetermined recording medium comprises a display section for displaying image forming status information data indicating a status of the image forming apparatus, a first storage section for storing corresponding to each other the plurality of image forming status information data and operable level information used for selecting the image forming status information data to be displayed the display section among the plurality of image forming status information data, a first interface section for connecting the image forming apparatus to an image processing apparatus having a function of reading optically an image on an original document, an image forming section for forming on the recording medium image data received from the image processing apparatus through the first interface section, an image processing apparatus status retrieving section for retrieving a status of the image processing apparatus from the image processing apparatus through the first interface section, a second storage section for storing corresponding to each other the plurality of image processing status information data indicating the status of the image processing apparatus connected through the interface section and the operable level information used for selecting among the plurality of image processing status information data the image processing status information data to be displayed on a display section of the image processing apparatus, a third storage section for storing the image forming status information data corresponding to the operable level information of the image forming apparatus, and a controller for selecting, based on the status of the image forming apparatus and the operable level information stored in the first storage section, the image forming status information data to be displayed on the display section of the image forming apparatus among the plurality of image forming status information data stored in the first storing section, and for selecting, based on the status of the image processing apparatus retrieved with the image processing apparatus status retrieving section and the operable level information stored in the second storage section, the image processing status information data to be displayed on the display section of the image processing apparatus among the plurality of image processing status information data stored in the second storage section, and for selecting, based on the operable level information stored in the first storage section, the image forming status information data to be displayed on the display section of the image processing apparatus among the plurality of image forming status information data stored in the third storage section.

The above described image forming apparatus according to this invention displays on the display section of the image processing apparatus defined as the other apparatus connected to the image forming apparatus, the status information data on the image forming apparatus in addition to the status information data on the image processing apparatus based on the operable level information. Consequently, with this image forming apparatus according to this invention, the user can make a judgment very easily as to whether the functions combined with those image processing apparatus and image forming apparatus are available or not with a simple structure at low cost.

To achieve the above described objects, the image forming apparatus according to this invention comprises an image forming section for forming an image on a predetermined recording medium, an image reading section for reading optically an image on an original document, a first display section for displaying image forming status information data indicating a status of the image forming section, a first storage section for storing corresponding to each other the plurality of image forming status information data and operable level information used for selecting the image forming status information data to be displayed on the first display section among the plurality of image forming status information data, a second display section for displaying image processing status information data indicating a status of the image reading section, a second storage section for storing corresponding to each other the plurality of image processing status information data and the operable level information used for selecting the image processing status information data to be displayed on the second display section among the plurality of image processing status information data, and a controller for selecting, based on the status of the image forming section and the operable level information stored in the first storage section, the image forming status information data to be displayed on the first display section among the plurality of image forming status information data stored in the first storage section, and for selecting, based on the status of the image reading section and the operable level information stored in the second storage section, the image processing status information data to be displayed on the second display section among the plurality of image processing status information data stored in the second storage section.

The above described image forming apparatus according to this invention is formed as the united apparatus for realizing the functions combined with the image forming function and the image reading function. The image forming apparatus according to this invention divides the status information data into groups by function and displays by function the status in one or plural number on the display section in accordance with the operable level information. Hence, the image forming apparatus according to this invention can avoid displaying the contents partial to a specific function, thereby being able to display the statuses of the other functions. With the image forming apparatus according to this invention, furthermore, the user can make a judgment very easily as to availability of each function, based on the operable level corresponding to the status information data displayed on the display section.

According to the invention, a plurality of apparatus statuses can be displayed approximately so that the user can make a judgment extremely easily as to whether the function combined with those apparatuses in plural number is available or not, with a simple structure at low cost.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein;

FIG. 15 is a view illustrating a display example on an operation panel of a printing apparatus according to the fourth embodiment of this invention;

FIG. 16 is a view illustrating a display example on an operation panel of a scanning apparatus according to the fourth embodiment of this invention;

FIG. 19 is a view illustrating an example of a coordination between a scanner status message and an updating time interval according to the image forming system.

DETAILED DESCRIPTION OF PREFERRED EMBODIMENTS OF THE INVENTION

Hereinafter, specific embodiments to which this invention applies will be described in detail in reference to drawings.

This embodiment is about an image forming system and an image forming apparatus for realizing a copying function upon combination of a scanning function reading optically images on an original document and a printing function forming images on a recording medium. The image forming system and the image forming apparatus particularly have a display unit for displaying both a status of a unit for realizing the scanning function and a status of a unit for realizing the printing function, and can display each status appropriately at low cost.

The image forming system according to the first embodiment is described first.

This image forming system is constituted upon connection of a scanning apparatus serving as a single image processing apparatus having the scanning function reading optically images on the original document and a printing apparatus serving as a single image forming apparatus having the printing function forming images on the predetermined recording medium, and realizes the copying function. Generally, with the image forming system of this type, both of the scanning apparatus and the printing apparatus have display units respectively. Herein, the display unit that a user visually confirms at a time of operation is located at the scanning apparatus. This image forming system is designed as a result of concentration to the above described viewpoints and displays a status of the printing apparatus as well as a status of the scanning apparatus on the display unit formed at the scanning apparatus.

Figure 1:
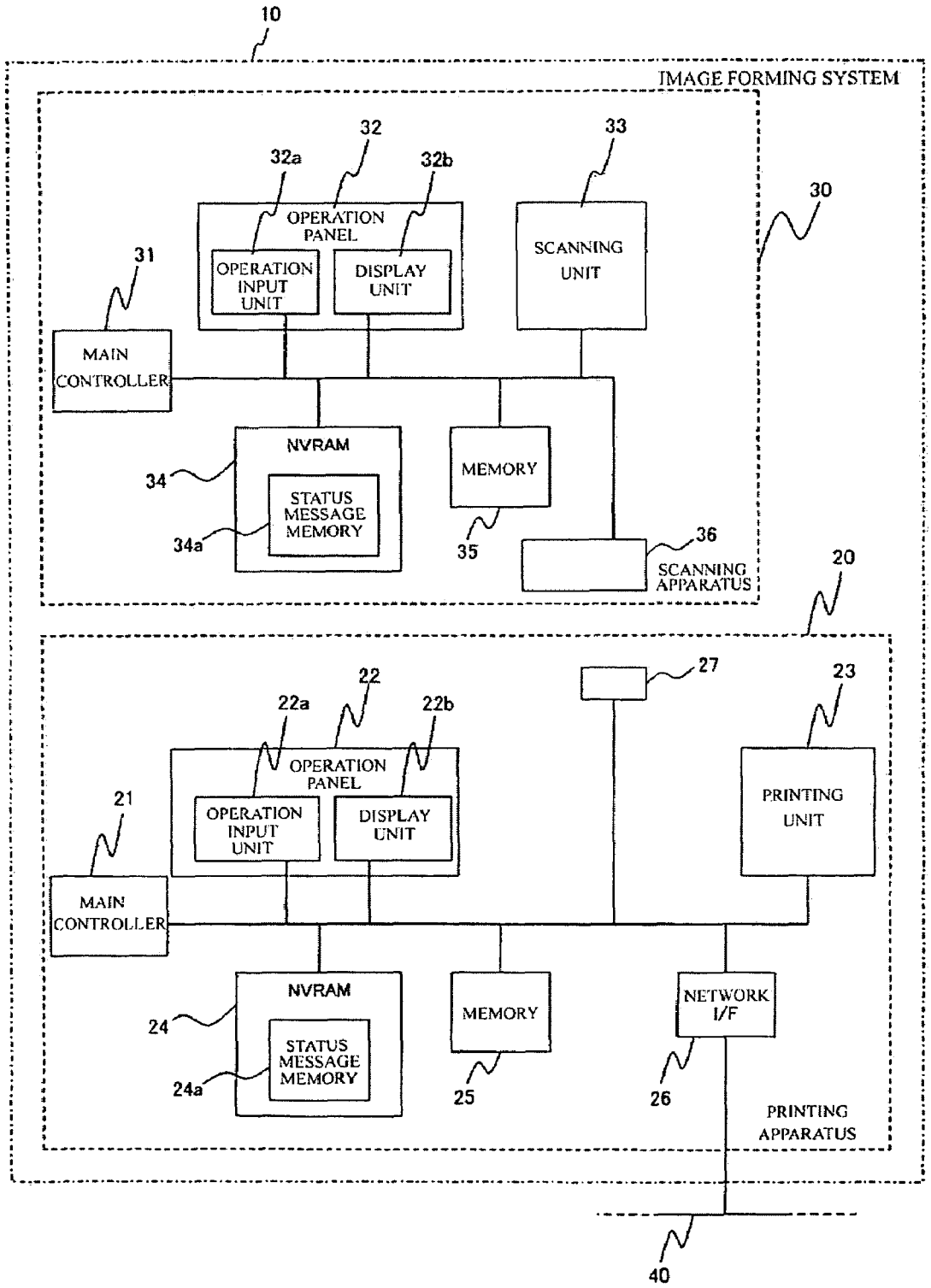
FIG. 1 is a block diagram illustrating a structure of an image forming system according to the first embodiment of this invention.

The image forming system according to the first embodiment is specifically composed as shown in FIG. 1. That is, the image forming apparatus 10 has an independently operable printing apparatus 20 and an independently operable scanning apparatus 30.

The printing apparatus 20 has a main controller 21 serving as a controlling section for controlling the printing apparatus 20 comprehensively, an operation panel 22 serving as a user interface for implementing various types of input operation and display, a printing unit 23 serving as an image forming section for forming images, an electrically erasable and writable nonvolatile random access memory 24 (hereinafter referred to as an NVRAM 24) serving as a storing section for storing various programs for controlling the operation of the printing function at the printing apparatus 20, a status message as described later, and the like, a memory 25 for storing various information, a network interface 26 for connecting the printing apparatus 20 to a network 40 connected to external apparatuses such as, e.g., a host computer or the like, and a local interface 27 serving as an interface section for connecting the printing apparatus 20 to the scanning apparatus 30.

The main controller 21 is composed of, e.g., a CPU (Central Processing Unit) or the like and controls the printing apparatus 20 comprehensively upon execution of various programs stored in the NVRAM 24.

The operation panel 22 has an operation input unit 22*a* composed of operating elements such as, e.g., various buttons, and switches for executing the printing function at the printing apparatus 20, and a display unit 22*b* serving as a display section for displaying various information data to be indicated such as, e.g., a condition or an operational status of the printing function. The operation panel 22 receives the input operation through the operation input unit 22*a* and supplies this information to the main controller 21 whereas displaying various information data on the display unit 22*b* under control by the main controller 21.

The printing unit 23 controls each member required for forming the image, such as each drive mechanism, e.g., a print head and the like to form the image on the recording medium under the control by the main controller 21.

The NVRAM 24 stores various programs for controlling the operation of the printing function at the printing apparatus 20. The program stored in the NVRAM 24 is read and executed by the main controller 21. Furthermore, the NVRAM 24 stores a group of messages indicating various statuses generated at the printing unit 23. The group of messages stored in the NVRAM 24 are displayed on the display unit 22*b* in the operation panel 22 based on the control by the main controller 21.

The memory 25 is composed of, e.g., the RAM or the like and functions as a work area for storing temporally each information required for execution of the program by the main controller 21 whereas storing the image data, system information, or the like transmitted from the external apparatus through the network 40. That is, each information is written in or read from the memory 25 based on the control by the main controller 21.

The network interface 26 is defined as an interface for connecting the printing apparatus 20 to the network 40 such as, e.g., a LAN (Local Area Network) or the like and executes a process for transferring signals between the main controller 21 and the external apparatuses connected to the network 40.

The local interface 27 is defined as an interface for connecting the printing apparatus 20 to the scanning apparatus 30 and executes a process for transferring signals between the main controller 21 and the scanning apparatus 30.

The printing apparatus 20 is formed as a single apparatus for forming the images on the predetermined recording medium such as, e.g., a recording sheet or the like. Furthermore, the printing apparatus 20 receives through the local interface 27 the image data of the image on the original document read with the scanning apparatus 30 and forms the image data on the recording medium, thereby realizing the copying function.

The scanning apparatus 30 has, on the other hand, a main controller 31 serving as a controlling section for controlling the scanning apparatus 30 comprehensively, an operation panel 32 serving as a user interface for implementing various types of input operation and display, a scanning unit 23 serving as a image reading section for reading the image on the original document optically, an NVRAM 34 serving as a storing section for storing various programs for controlling the operation of the scanning function or the copying function at the scanning apparatus 30, a status message, or the like, a memory 35 for storing various information, and a local interface 36 serving as an interface section for connecting the scanning apparatus 30 to the printing apparatus 20.

The main controller 31 is composed of, e.g., a CPU or the like and controls the scanning apparatus 30 comprehensively upon execution of various programs stored in the NVRAM 34.

The operation panel 32 has both an operation input unit 32*a* composed of operating elements such as, e.g., various buttons, switches, or the like, for executing the scanning function at the scanning apparatus 30 or the copying function upon combination with the printing apparatus 20 and a display unit 32*b* serving as a display section for displaying various information to be indicated such as, e.g., a condition or an operational status of the printing function or the scanning function, or the like. The operation panel 32 receives the input operation through the operation input unit 32*a* and supplies this information to the main controller 31 whereas displaying each information on the display unit 32*b* under the control by the main controller 31.

The scanning unit 33 controls each of members required for reading the image on the original document, such as each drive mechanism, e.g., the print head or the like to read optically the image on the original document.

The NVRAM 34 stores various programs for controlling the operation of the scanning function at the scanning apparatus 30 or the copying function upon combination with the printing apparatus 20. The program stored in the NVRAM 24 is read and executed by the main controller 31. Furthermore, the NVRAM 34 stores a group of messages indicating various statuses generated at the scanning unit 33 and in the printing unit 23. The group of messages stored in the NVRAM 34 are displayed on the display unit 32*b* in the operation panel 32 under the control by the main controller 31.

The memory 35 is composed of, e.g., the RAM or the like and functions as a work area for storing temporally each information required for execution of the program by the main controller 31 whereas storing the image data on the original document read with the scanning unit 33, system information, or the like. That is, each information is written in or read from the memory 35 based on the control by the main controller 31.

The local interface 36 is defined as an interface for connecting the scanning apparatus 30 to the printing apparatus 20 and executes a process for transferring signals between the main controller 31 and the printing apparatus 20.

The scanning apparatus 30 is formed as a single apparatus for reading optically the image on the original document, printed on the predetermined recording medium such as, e.g., the recording sheet or the like. Furthermore, the scanning apparatus 30 transmits the image data of the read image on the original document to the printing apparatus 20 through the local interface 36, thereby realizing the copying function.

Figure 2:
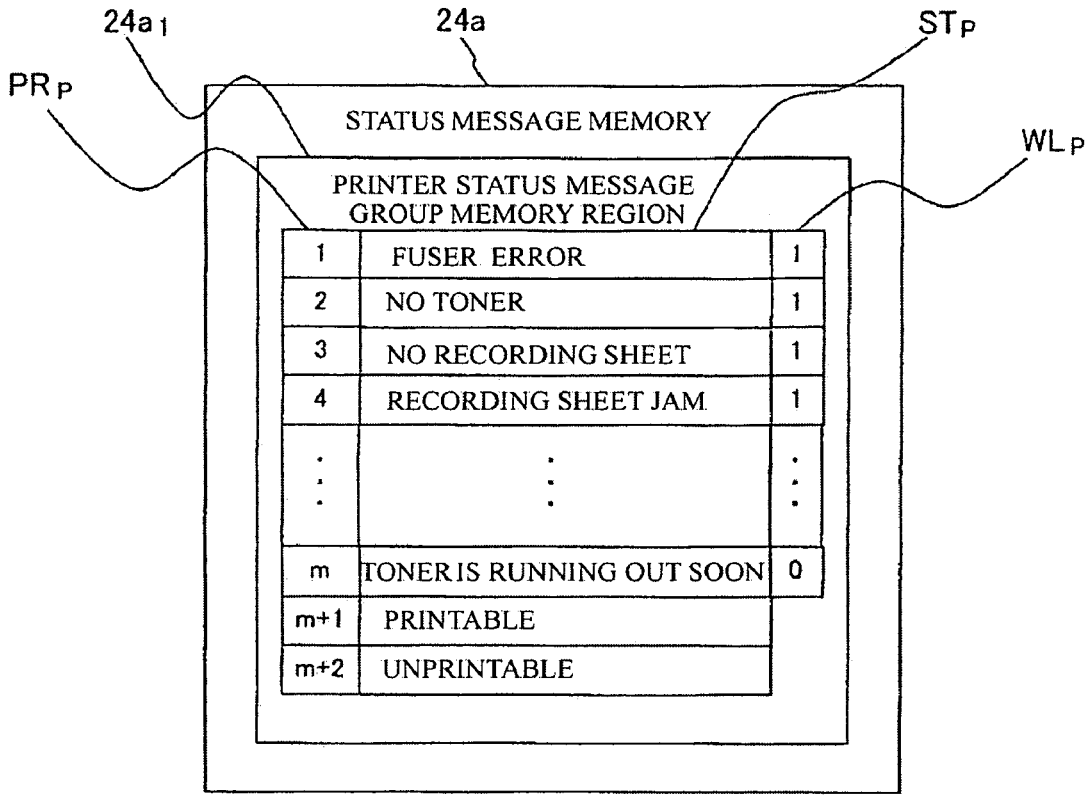
FIG. 2 is a view illustrating information example to be stored in a status message memory formed in an NVRAM composing a printing apparatus according to the image forming system.

With the image forming system 10 as described above, the printing apparatus 20 is constituted, as shown in FIG. 2, upon forming in the NVRAM 24 a status message memory 24*a* for storing the status message such as displayed on the display unit 22*b* to report the status of the printing apparatus 20. The status message memory 24*a* is formed with a printer status message group memory region 24$a_1$ for storing a group of messages respectively indicating the statuses generated at the printing unit 23. The printer status message group memory region 24$a_1$ stores the status message STp such as, e.g., a message for indicating a status that an error has occurred during operation of a fuser, a status that toner run out, a status that the recording sheet run out, a status that the recording sheet gets jammed, a status that the toner is running out, a printable status, an unprintable status, or the like. The printer status message group memory region 24$a_1$ stores these various messages STp corresponding to attributes, i.e., a priority PRp and a warning level MLp defined as the operable level information used for selecting the status message to be displayed on the display unit 22*b*. It is to be noted that the priority PRp is defined as a parameter for indicating order of priorities in reporting to the user on the plurality of statuses presently caused whereas the warning level WLp is defined as a parameter for indicating as to whether printing is operable or not at the event of the corresponding status, for example. In FIG. 2, the warning level WLp equal to "one" indicates the unprintable status whereas the warning level WLp equal to "zero" indicates the printable status.

Figure 3:
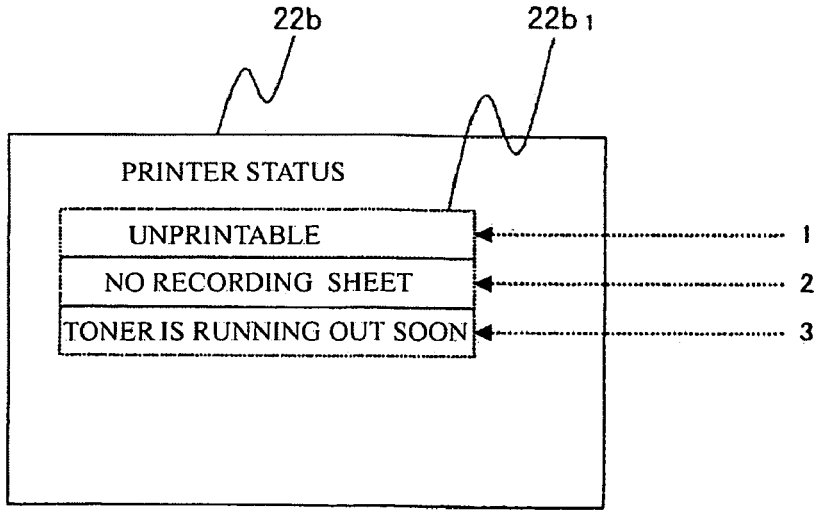
FIG. 3 is a view illustrating a display example on a printer status message display region formed in a display unit composing the printing apparatus according to the image forming system.

The printing apparatus 20 stores those various status messages STp in the printer status message group memory region 24$a_1$, in the status message memory 24*a* formed in the NVRAM 24. The printing apparatus 20 furthermore reads, based on the control by the main controller 21, the necessary status message to be reported among the various status messages STp stored in the printer status message group memory region 24$a_1$ and displays the read status message on a printer status message display region 22$b_1$ formed at the display unit 22*b* on the operation panel 22, as shown in FIG. 3 for example. It is to be noted that FIG. 3 shows a case where three status messages are displayable at a maximum with respect to the status of the printing apparatus 20.

Figure 4:
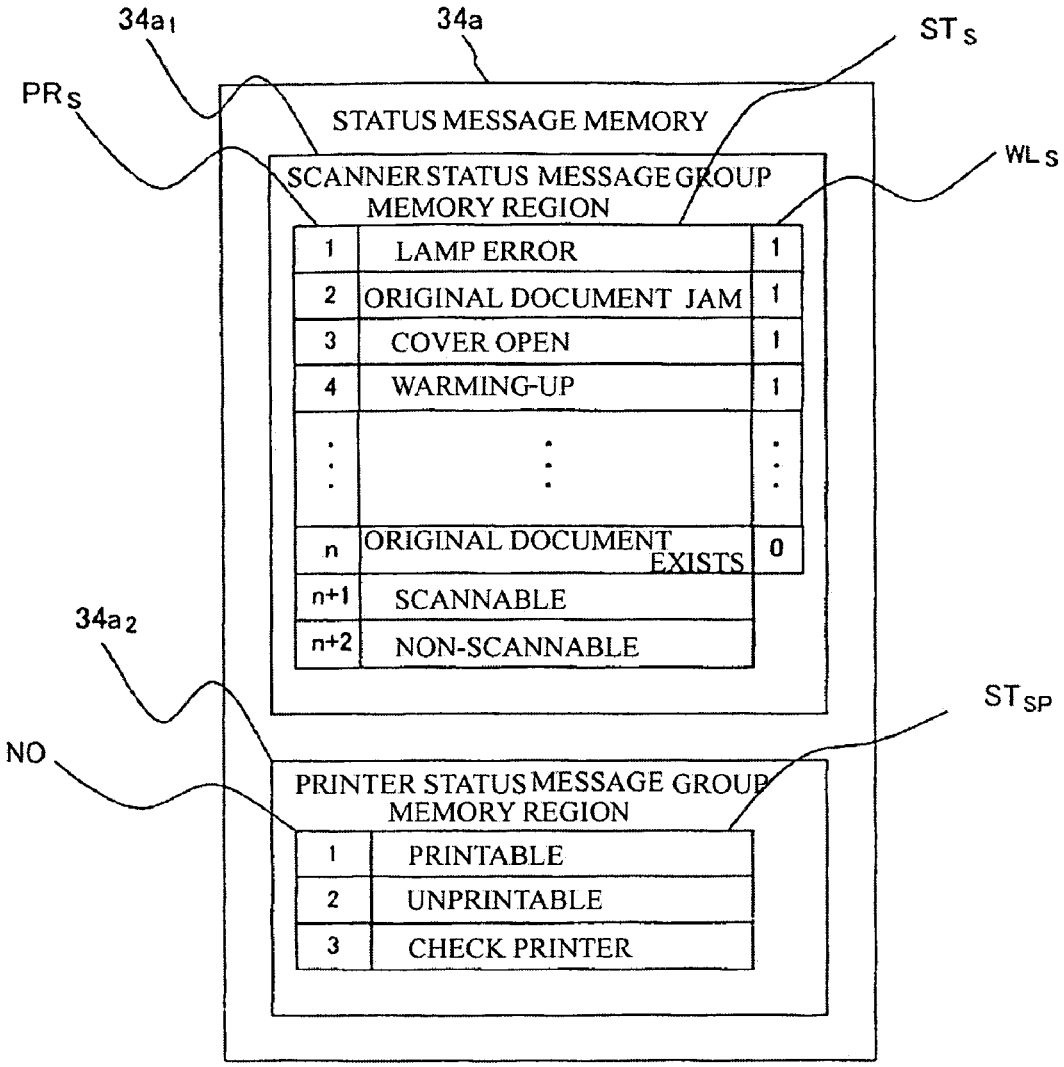
FIG. 4 is a view illustrating an information example to be stored in a status message memory formed in an NVRAM composing a scanning apparatus according to the image forming system.

On the other hand, the scanning apparatus 30 is constituted, as shown in FIG. 4, upon forming in the NVRAM 35 the status massage memory 34*a* for storing the status message such as displayed on the display unit 32*b* to report the statuses of both the scanning apparatus 30 and the printing apparatus 20. The status message memory 34*a* is formed with a scanner status message group memory region 341$a_1$ for storing a group of messages respectively indicating the statuses generated at the scanning unit 33. The scanner status message group memory region 341$a_1$ stores the status messages STs such as, e.g., massage indicating a status that an error has occurred during operation of a lamp, a status that the original document gets jammed, a status that a cover of an original document board stacked with the original document is open, an warming-up status, a status that the original document is stacked on the original document board, a status where the original document is readable, a status that the original document is readable, or the like. The scanner status message group memory region 34$a_1$ stores these various messages STp corresponding to attributes, i.e., a priority PRs and a warning level MLs defined as the operable level information used for selecting the status message to be indicated on the display unit 32*b*. It is to be noted that the priority PRs is defined as a parameter for indicating order of priorities in reporting to the user on the plurality of statuses presently caused whereas the warning level WLs is defined as a parameter for indicating as to whether the original document is readable or not at the event of the corresponding status, for example. In FIG. 4, the warning level WLs equal to "one" indicates the unreadable status whereas the warning level WLs equal to "zero" indicates the readable status. Furthermore, the status message memory 34*a* is formed with a printer status message group memory region 34$a_2$ for storing a group of messages for respectively indicating statuses generated at the printing unit 23 of the printing apparatus 20. Status messages STsp stored in the printer status message group memory region 34$a_2$ consists of at least a message for indicating a printable status, a message for indicating an unprintable status, and a message for requesting a status confirmation of the printer apparatus 20. The printer status message group memory region 34$a_2$ stores those various status messages STsp corresponding to a status message number.

Figure 5:
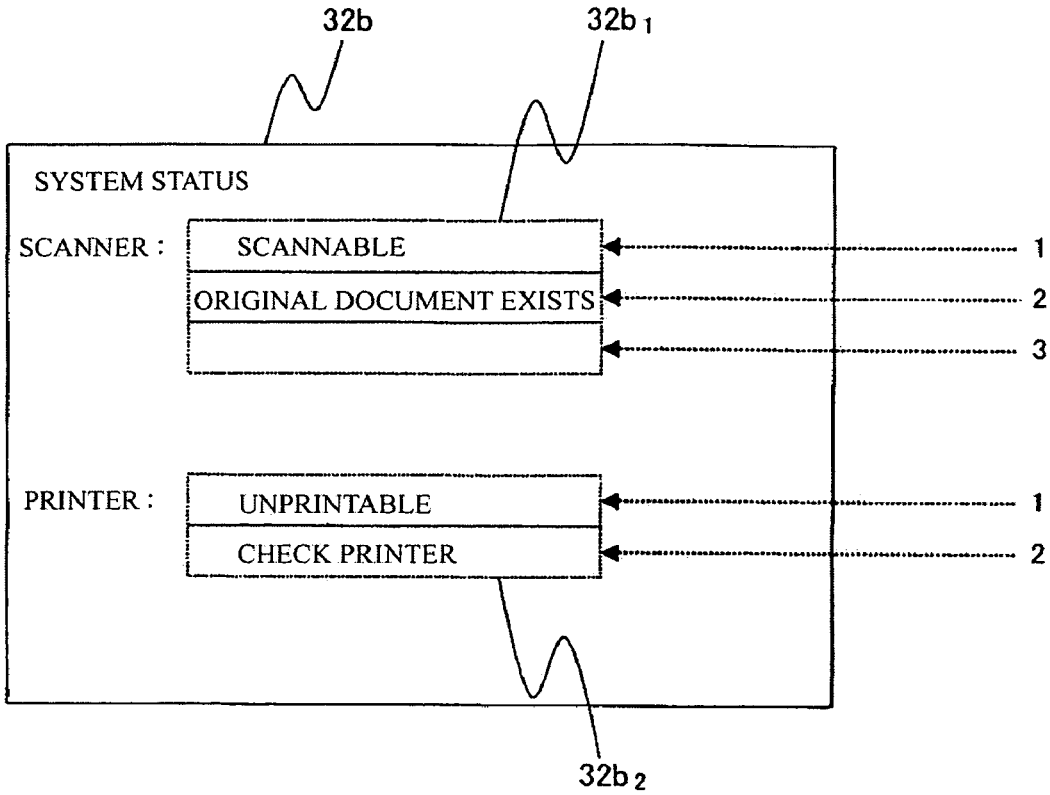
FIG. 5 is a view illustrating a display example on a scanner status message display region and a printer status message display region formed in a display unit composing the scanning apparatus according to the image forming system.

The scanning apparatus 30 stores those various status messages STs in the scanner status message group memory region 34$a_1$ in the status message memory 34*a* formed in the NVRAM 34 whereas storing the various status message STsp in the printer status message group memory region 34$a_2$ in the status message memory 34*a* formed in the NVRAM 34. The scanning apparatus 30 furthermore reads, based on the control by the main controller 31, the necessary status message to be reported among the various status messages STs stored in the scanner status message group memory region 34$a_1$ and displays the read status message on a scanner status message display region 32$b_1$ formed at the display unit 32*b* on the panel 32, as shown in FIG. 5 for example. Furthermore, the scanning apparatus 30 reads, based on the control by the controller 31, the necessary status message to be reported among the various status messages STsp stored in the printer status message group memory region 34$a_2$ depending on a status of the printing apparatus 20 retrieved from the printing apparatus 20 through the local interface 36 and displays the read status message on a printer status message display region 32$b_2$ formed at the display unit 32*b* on the operation panel 32. It is to be noted that FIG. 5 shows a case where three status messages are displayable at maximum with respect to the status of the scanning apparatus 30 whereas two status messages are displayable at maximum with respect to the status of the printing apparatus 20.

Figure 6:
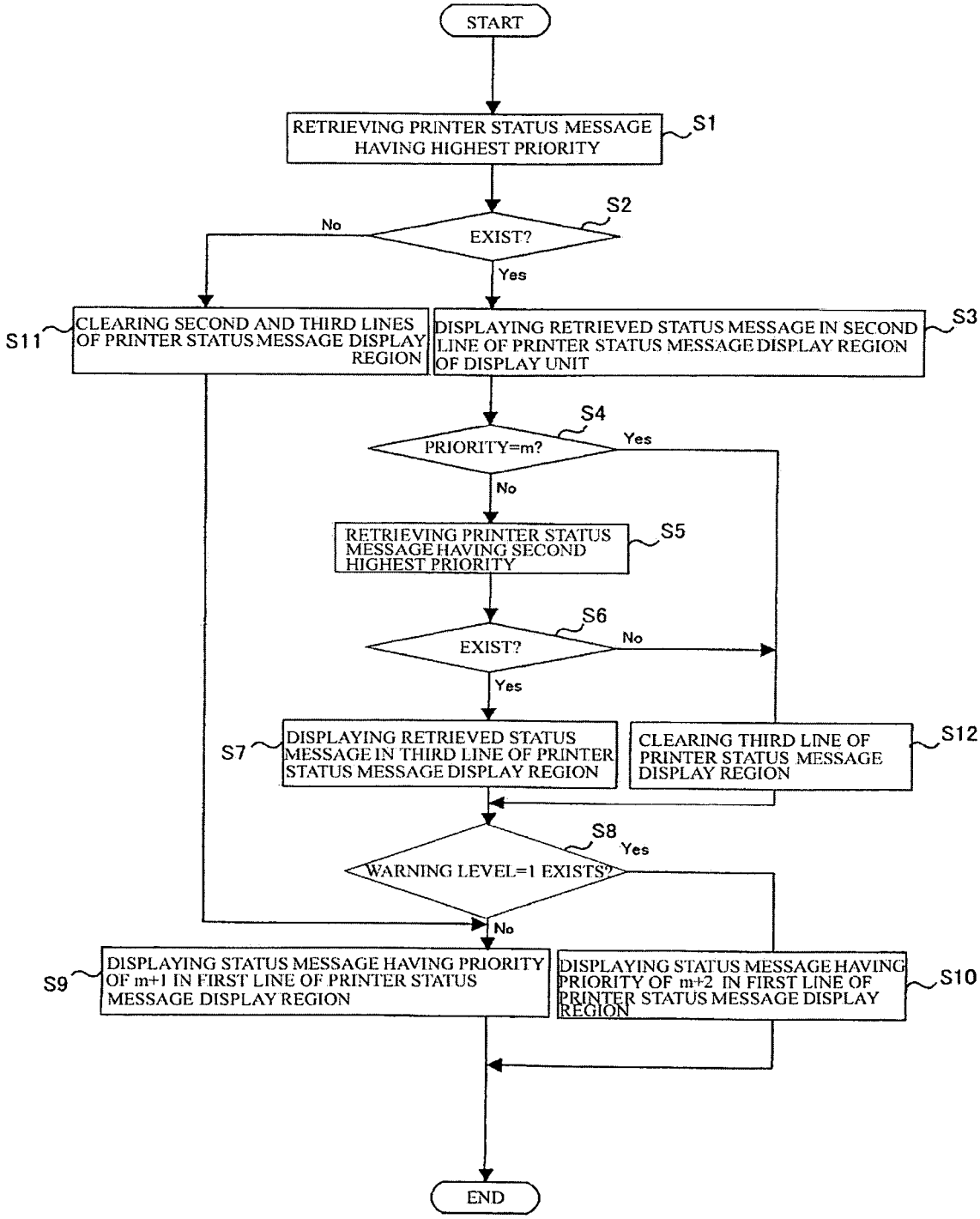
FIG. 6 is a flow chart illustrating a sequential process to be executed in a case of change in a status of a printing unit of a printing apparatus according to the image forming system.

With the image forming system 10 as described above, the printing apparatus 20 proceeds the sequence of operational steps such as shown in FIG. 6 to execute a process for displaying the status on the display unit 22*b* in the operation panel 22. It is to be noted that this process is stored in the NVRAM 24 as a program to be read and executed by the main controller 21 and to be executed in a case of change in the status of the printing unit 23.

As shown in FIG. 6, the main controller 21 first retrieves at step S1 the status message STp corresponding to a status having the highest priority PRp among the statuses occurred in the printing unit 23 in reference to the status messages STp having the priorities PRp from "one" to "m", stored in the printer status message group memory region 24$a_1$. The main controller 21 makes a judgment at step S2 as to whether the corresponding status message STp is retrieved or not.

Where making a judgment that the corresponding status message STp is retrieved, the main controller 21 displays the retrieved status message STp in the second line of the printer status message display region 22$b_1$ formed at the display unit 22*b* in the operation panel 22 at step S3 and makes a judgment as to whether the priority PRp corresponding to the retrieved status message STp is equal to "m" at step S4.

The main controller 21 retrieves the status message STp corresponding to a status having the second highest priority PRp at step S5 where making a judgment that the priority PRp corresponding to the retrieved status message STp is not equal to "m". The main controller 21 furthermore makes a judgment at step S6 as to whether the corresponding status message STp is retrieved.

The main controller 21 displays the retrieved status message STp in the third line of the printer status message display region 22$b_1$ at step S7 where making a judgment that the corresponding status message STp is retrieved. The main controller 21 then makes a judgment at step S8 as to whether the warning level WLp subject to the status message STp retrieved at step S1 and/or the step S5 is equal to "one", or namely as to existence of the status message STp having the attribute meaning the unprintable status.

Where making a judgment of nonexistence of the status message STp having the attribute meaning the "unprintable" status, the main controller 21 displays in the first line of the printer status message display region 22$b_1$ the status message STp having the priority PRp of "m+1", or namely the status message STp indicating the "printable" status and completes at step S9 this sequence of operational steps. On the other hand, where making a judgment of existence of the status massage STp having the attribute meaning the "unprintable" status, the main controller 21 displays in the first line of the printer status message display region 22$b_1$ the status message STp having the priority PRp of "m+2", or namely the status message STp indicating the "unprintable" status and completes at step S110 this sequence of operational steps.

Furthermore, where making a judgment that the corresponding status message STp is not retrieved at step S2, the controller 21 clears both the second and third lines of the printer status message display region 22$b_1$ at step S11 and subsequently shifts this process to step S9 to display in the first line of the printer status message display region 22$b_1$ the status message STp having the priority PRp of "m+1", or namely the status message STp indicating the "printable" status and to complete this sequence of operational steps.

Where making a judgment that the priority PRp corresponding to the status message STp retrieved at step S4 is equal to "m", or that the corresponding status message STp is not retrieved at step S6, the main controller 21 shifts this operation to step S12 to clear the third line of the printer status message display region 22$b_1$ and then shifts this operation to the operational steps subsequent to step S8.

In the event of change in the status of the printing unit 23, the printing apparatus 20 selects, based on the operable level information, the status message to be displayed on the display unit 22$b$ among the plurality of status messages STp stored in the NVRAM 24 upon processing this sequence of operational steps. That is, the printing apparatus 20 displays in the printer status message display region 22$b_1$ the status message having the warning level WLp equal to "one" meaning the "unprintable" status in priority to the other status messages upon processing this sequence of operational steps. In a case of nonexistence of the status message as described above, the printing apparatus 20 can display in the printer status message display region 22$b_1$ the status messages sequentially in the order of priority from highest to lowest. It is to be noted that the above mentioned display example of the printer status message display region 22$b_1$ shown in FIG. 3 shows a display example in which the message for indicating the "unprintable" status is displayed in the first line, and in which the message having the priority PRp equal to "three" and the warning level WLp equal to "one", for indicating the status that "the recording sheets run out" is displayed in the second line, and in which the message having the priority PRp of "m" and the warning level WLp equal to "zero", for indicating the status that "the toner is running out" is displayed in the third line.

Figure 7:
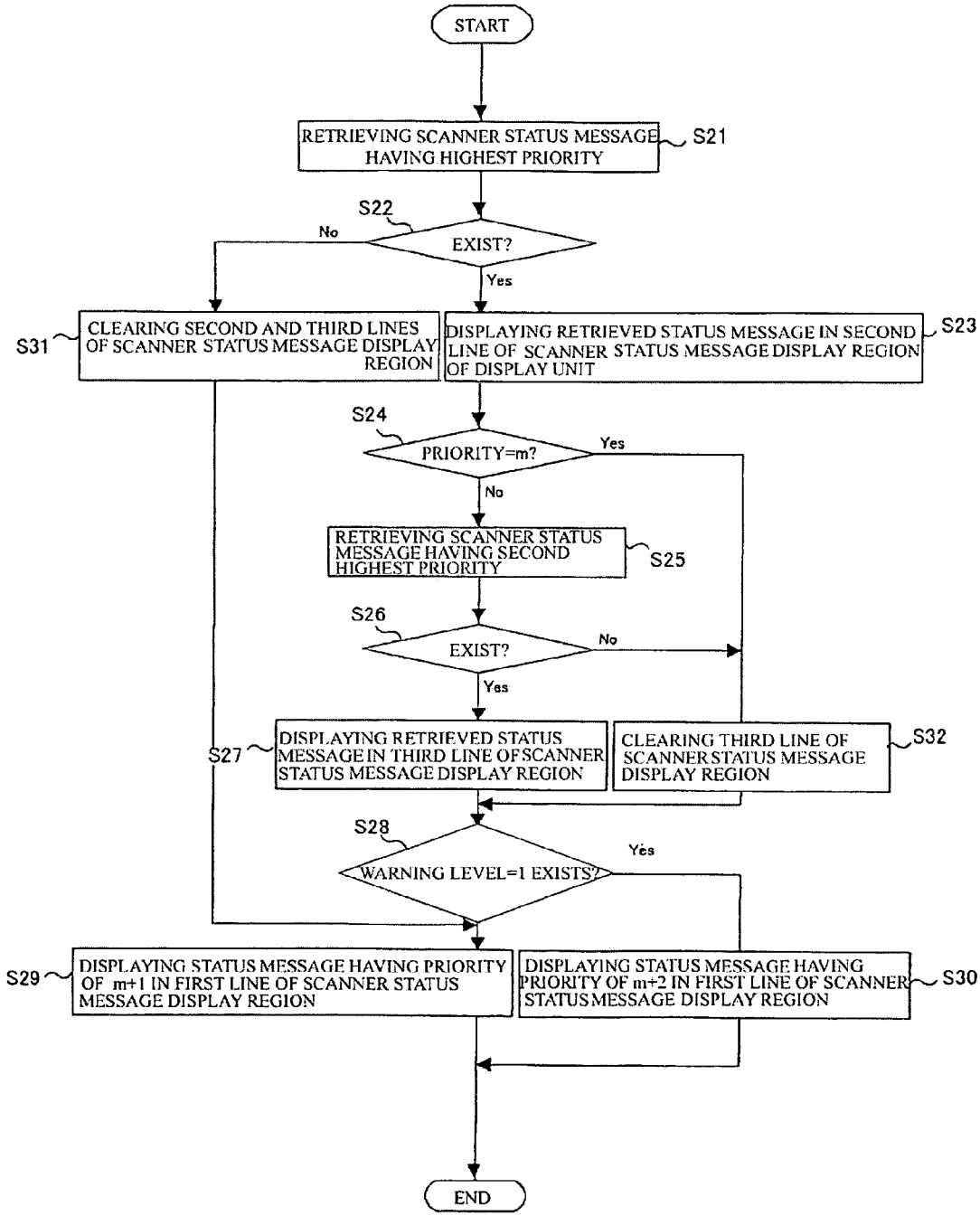
FIG. 7 is a flow chart illustrating a sequential process to be executed in a case of change in a scanning unit of a scanning apparatus according to the image forming apparatus.
Figure 8:
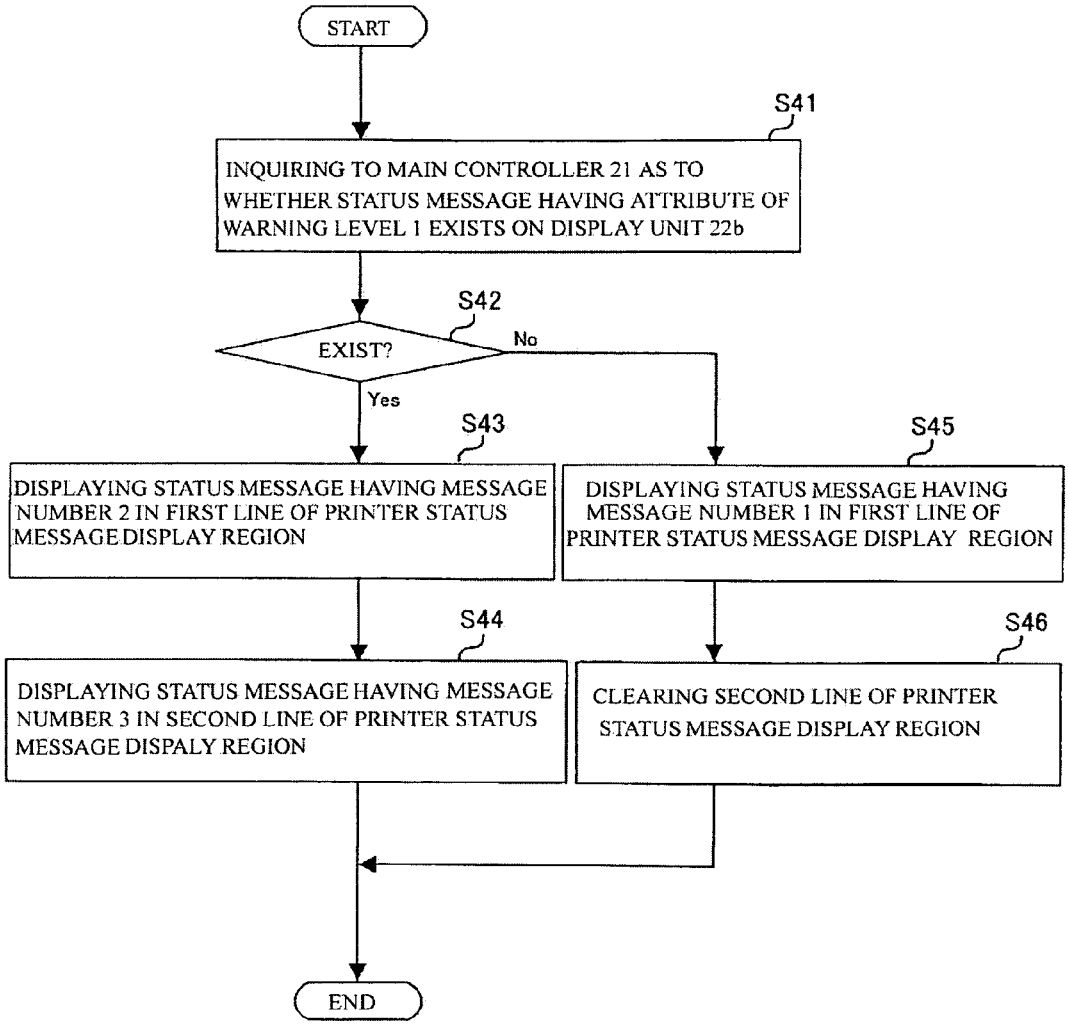
FIG. 8 is a flow chart illustrating a sequential process to be executed in a case of change in a content displayed on the printer status message display region formed in a display unit of the printing apparatus according to the image forming apparatus.

On the other hand, the scanning apparatus 30 proceeds this sequence of operational steps such as shown in FIG. 7 and FIG. 8 to implement the operational steps for displaying the status on the display unit 32$b$ at the operation panel 32. Those operational steps are stored in the NVRAM 34, as a program to be read and executed by the controller 31. Among those, the operational steps shown in FIG. 7 are to be executed in the event of change in a status of the scanning unit 33 whereas the operational steps shown in FIG. 8 are to be executed in the event of change in a content displayed on the printer status message display region 22$b_1$ formed at the display unit 22$b$ of the printing apparatus 20.

The operational steps to be executed in the event of change in the status of scanning unit 33 are explained in reference to FIG. 7.

As shown in FIG. 7, the main controller 31 retrieves at step S21 the status message STs corresponding to a status having the most high priority PRs among statuses generated at the scanning unit 33 in reference to the status messages STs having the priorities PRs from "one" to "n", stored in the scanner status message group memory region 34$a_1$. The main controller 31 makes a judgment at step S22 as to whether the corresponding status message STs is retrieved or not.

Where making a judgment that the corresponding status message STs is retrieved, the main controller 31 displays the retrieved status message STs in the second line of the scanner status message display region 32$b_1$ formed at the display unit 32$b$ in the operation panel 32 at step S23 and makes a judgment as to whether the priority PRs corresponding to the retrieved status message STs is equal to "n" at step S24.

The main controller 31 retrieves the status message STs corresponding to a status having the second highest priority PRs at step S25 where making a judgment that the priority PRs corresponding to the retrieved status message STs is not equal to "n". The main controller 31 furthermore makes a judgment at step S26 as to whether the corresponding status message STs is retrieved or not.

The main controller 31 displays the retrieved status message STs in the third line of the scanner status message display region 32$b_1$ at step S27 where making a judgment that the corresponding status message STs is retrieved. The main controller 31 then makes a judgment at step S28 as to whether the warning level WLs assigned to the status message STs retrieved at step S21 and/or the step S25 is equal to "one", or namely as to existence of the status message STs having the attribute meaning the "original document unreadable" status.

Where making a judgment of nonexistence of the status message STs having the attribute meaning the "original document unreadable" status, the main controller 31 displays in the first line of the scanner status message display region 32$b_1$ the status message STs having the priority PRs of "n+1", or namely the status message STs indicating the "original document readable" status and completes at step S29 this sequence of operational steps. On the other hand, where making a judgment of existence of the status massage STs having the attribute meaning the "original document unreadable" status, the main controller 31 displays in the first line of the scanner status message display region 32$b_1$ the status message STs having the priority PRs of "n+2", or namely the status message STs indicating the "original document unreadable" status and completes at step S30 this sequence of operational steps.

Furthermore, where making a judgment that the corresponding status message STs is not retrieved at step S22, the main controller 31 clears both the second and third lines of the scanner status message display region $32b_1$ at step 31 and subsequently shifts this operation to step S29 to display in the first line of the scanner status message display region $32b_1$ the status message STs having the priority PRs of "n+1", or namely the status message STs indicating the "original document readable" status and then completes this sequence of operational steps.

Where making a judgment that the priority PRs corresponding to the status message STs retrieved at step S24 is equal to "n", or that the corresponding status message STs is not retrieved at step S26, the main controller 31 shifts this operation to step S32 to clear the third line of the scanner status message display region 32*b*, and then shifts this operation to the operational steps subsequent to step S28.

In the event of change in the status of the scanning unit 33, the scanning apparatus 30 selects, based on the operable level information, the status message to be displayed on the display unit 32*b* among the plurality of status messages STs stored in the NVRAM 34. That is, the scanning apparatus 30 displays in the scanner status message display region $32b_1$ the status message having the warning level WLs equal to "one" meaning the "original document unreadable" status in priority to the other status messages upon processing this sequence of operational steps. In a case of nonexistence of the status message as described above, the scanning apparatus 30 can display in the scanner status message display region $32b_1$ the status messages sequentially in the order of priority from highest to lowest. It is to be noted that the above mentioned display example of the scanner status message display region $32b_1$ shown in FIG. 5 shows a display example in which the message for indicating the "original document unreadable" status is displayed in the first line, and in which the message having the priority PRs of "n" and the warning level WLs equal to "zero", for indicating the status that "the original document is stacked on the original document board" is displayed in the second line.

Next, the operational steps to be executed in the event of change in the content displayed on the printer state message display region $22b_1$ formed at the display unit 22*b* of the printing apparatus 20 are described in reference to FIG. 8.

To execute the above mentioned operational steps, the main controller 31 needs to make a confirmation as to whether the content displayed on the printer state message display region $22b_1$ formed at the display unit 22*b* of the printing apparatus 20 changes or not. Such forms is assumed as a method for the above confirmation, that the main controller 31 periodically makes an inquiry to the main controller 21 of the printing apparatus 20 through the local interfaces 36, 27 at predetermined time interval, or that the main controller 21 of the printing apparatus 20 notifies the main controller 31 through the local interfaces 27, 36 in the event of change in the content displayed on the printer status message display region $22b_1$ formed at the display unit 22*b* of the printing apparatus 20. With the image forming system 10, either of those above described forms can be used as a method for making a confirmation as to whether the content displayed on the printer state message display region $22b_1$ formed at the display unit 22*b* of the printing apparatus 20 changes or not. In the below described description in reference to FIG. 8, such a confirmation is to be made using either of those above forms, that the content displayed on the printer state message display region $22b_1$ formed at the display unit 22*b* of the printing apparatus 20 has changed.

First, the main controller 31 operates as an operable level information retrieving section to retrieve the operable level information of the printing apparatus 20 where making a confirmation that the content displayed on the printer state message display region $22b_1$ formed at the display unit 22*b* of the printing apparatus 20 has changed. That is, the main controller 31 makes an inquiry at step S41 as shown in FIG. 8 to the main controller 21 through the local interfaces 36, 27, as to whether the status message STp having the warning level WLp equal to "one", or namely the status message STp having the attribute meaning the "unprintable" status, exists among the status messages STp displayed on the display unit 22*b*.

Where making a judgment, as a result of the above inquiry, that the status message STp having the warning level WLp equal to "one" exists among the status messages STp displayed on the display unit 22*b*, the main controller 31 shifts the operation to step S43 to display in the first line of the printer status message display region $32b_2$ the status message STsp having the status message number equal to "two" stored in the printer status message group memory region $34a_2$, or namely the status message STsp indicating the "unprintable" status. The main controller 31 subsequently displays in the second line of the printer status message display region $32b_2$ the status message STsp having the status message number equal to "three" stored in the printer status message group memory region $34a_2$, or namely the status message STsp indicating the status that "a confirmation as to the status of the printing apparatus 20 is required" and completes this sequence of operational steps at step S44.

On the other hand, where making a judgment that the status message STp having the warning level WLp equal to "one" does not exist among the status messages STp displayed on the display unit 22*b*, the main controller 31 shifts the operation to step S45 to display in the first line of the printer status message display region $32b_2$ the status message STsp having the status message number equal to "one" stored in the printer status message group memory region $34a_2$, or namely the status message STsp indicating the "printable" status. The main controller 31 subsequently clears the second line of the printer status message display region $32b_2$ and completes this sequence of operational steps at step S46.

In a case where a status displayed on the printer status message display region $22b_1$, formed at the display unit 22*b* of the printing apparatus 20 changes, the scanning apparatus 30 selects, based on such operable level information of the printing apparatus 20 as retrieved from the printing apparatus, the status message to be displayed on the display unit 32*b* among the plurality of status messages STsp stored in the NVRAM 34 upon processing this sequence of operational steps, thereby being able to display on the printer status message display region $32b_2$ the status message corresponding the content displayed on the printer status message display region $22b_1$. It is to be noted that the above mentioned display example of the printer status message display region $32b_2$ shown in FIG. 5 shows a display example in which both of the status message corresponding to the status message having the warning level WLp equal to "one" in the display example of the printer status message display region $22b_1$, shown in FIG. 3 as described above, or namely the status message for indicating the "unprintable"

status and the status message for indicating the status that "a confirmation as to the status of the printing apparatus 20 is required".

As described above, the image forming system 10 described as the first embodiment is focused on operating characteristics of the user in using the copying function resulted from connection of the printing apparatus 20 and the scanning apparatus 30 which are both operated independently, and thus displays based on the operable level information the status message for indicating whether the printing function at the printing apparatus 20 is available or not in addition to the status message of the scanning apparatus 30 on the display unit 32*b* at the operation panel 32 formed at the scanning apparatus 30. Consequently, with the image forming system 10, the user having intention of using the copying function can make a judgment so easily as to whether the copying function is presently available or not. Furthermore, it is only necessary to display the status message for indicating whether the printing function at the printing apparatus 20 is available or not as the status message of the printing apparatus 20 to be displayed on the display unit 32*b* on the operation panel 32 formed to the scanning apparatus 30, so that it is unnecessary to form to the scanning apparatus 30 the display region for displaying the status message for indicating whether the printing function at the printing apparatus 20 is available or not, to store all the status messages to be displayed on the display unit 22*b* of the printing apparatus 20 in the scanning apparatus 30, nor to complicate the structure to display the pictorial symbols such as, e.g., icons or the like, corresponding to the statuses respectively, and thus the cost reduction can be intended. Therefore, the image forming system 10 can meet flexibly the specification change of each of those printing apparatus 20 and scanning apparatus 30 without limited by combination of those.

The image forming system as the third embodiment is described next.

The image forming system as the second embodiment does not operate both of the printing apparatus 20 and the scanning apparatus 30, not likewise the image forming system 10 as the first embodiment, but is structured upon connecting the independently inoperable scanning apparatus as an option unit to the independently operable printing apparatus. In the description for the second embodiment, therefore, substantially the same structures as those in the first embodiment are assigned with the same reference numbers as in the first embodiment, and for the sake of simplicity, those duplicated descriptions are omitted.

Figure 9:
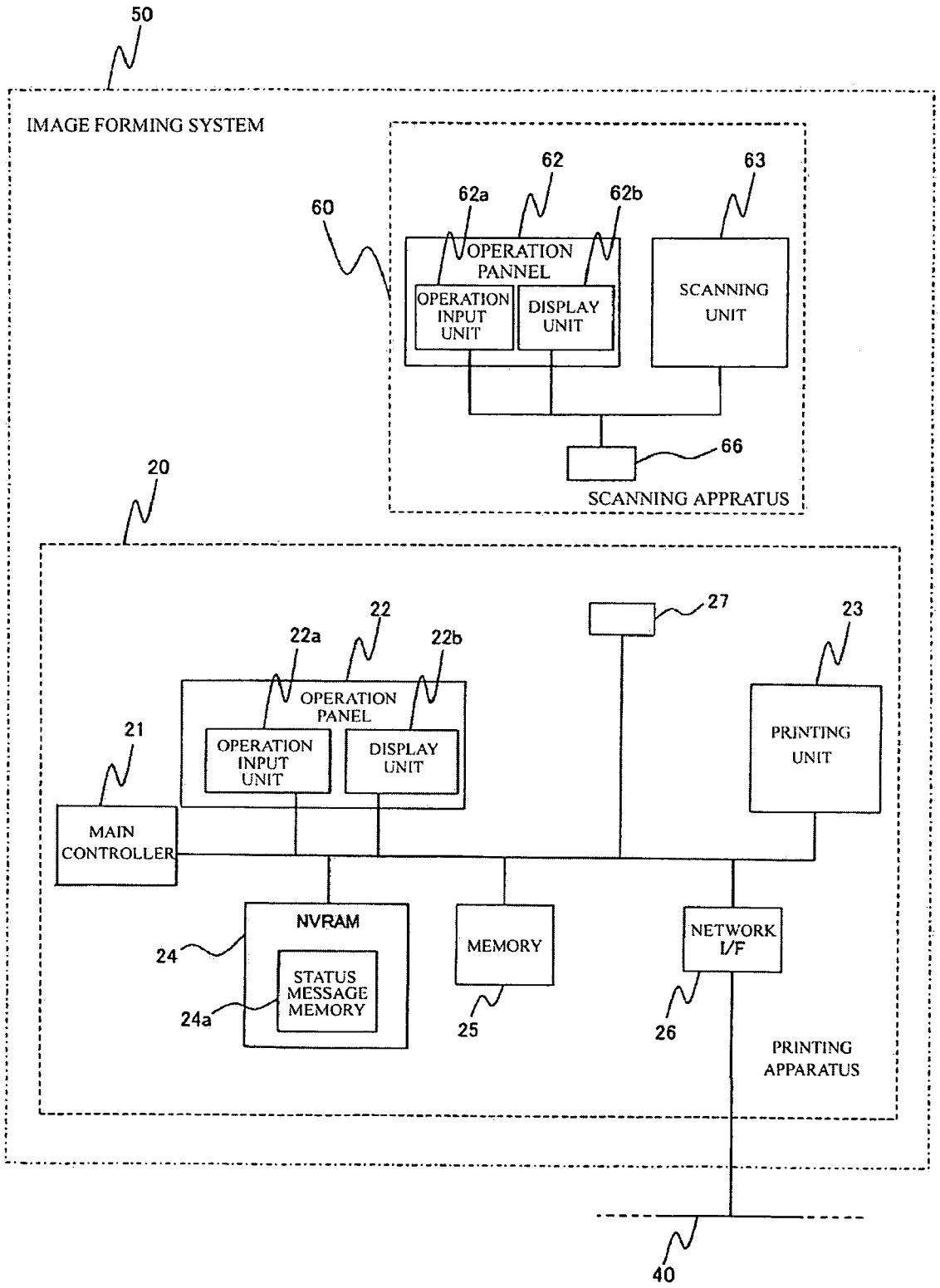
FIG. 9 is a block diagram illustrating a structure of an image forming system according to the second embodiment of this invention.

The image forming system described as the second embodiment is structured as shown in FIG. 9. That is, with this image forming system 50, a independently inoperable scanning apparatus 60 is connected as the option unit in a detachable and attachable manner to the independently operable printing apparatus 20.

The scanning apparatus 60 has such a structure that all of the main controller 31, the NVRAM 34, and the memory 35 are removed from the scanning apparatus 30 as shown in FIG. 1. That is, the scanning apparatus 60 has an operation panel 62 serving as a user interface for implementing various types of input operation and display, a scanning unit 63 serving as an image reading section for reading optically the image on the original document, and a local interface 66 serving as an interface section for connecting the scanning apparatus 60 to the printing apparatus 20. Among those, the operation panel 62 has both an operation input unit 62*a* composed of operating elements such as, e.g., various buttons, switches, or the like, for executing the scanning function at the scanning apparatus 60 or the copying function upon combination of the scanning apparatus 60 and the printing apparatus 20 and a display unit 62*b* serving as a display section for displaying the status of the scanning function or the printing function, the operational status, or the other various information to be indicated.

The scanning apparatus 60 as described above is connected to the printing apparatus 20 through the local interface 66 and structured to read optically such the image on the original document as printed on the predetermined recording medium such as, e.g., the recording paper or the like, based on the control by the main controller 21 of the printing apparatus 20. That is, the printing apparatus 20 stores in the NVRAM 24 various programs for controlling the operation of the scanning function at the scanning apparatus 60 or the copying function upon combination of the scanning apparatus 60 with the printing apparatus 20, and thus is provided with the scanning function at the scanning apparatus 60 or the copying function upon combination of the scanning apparatus 60 with the printing apparatus 20 in addition to the printing function by execution of those programs by the main controller 21.

Figure 10:
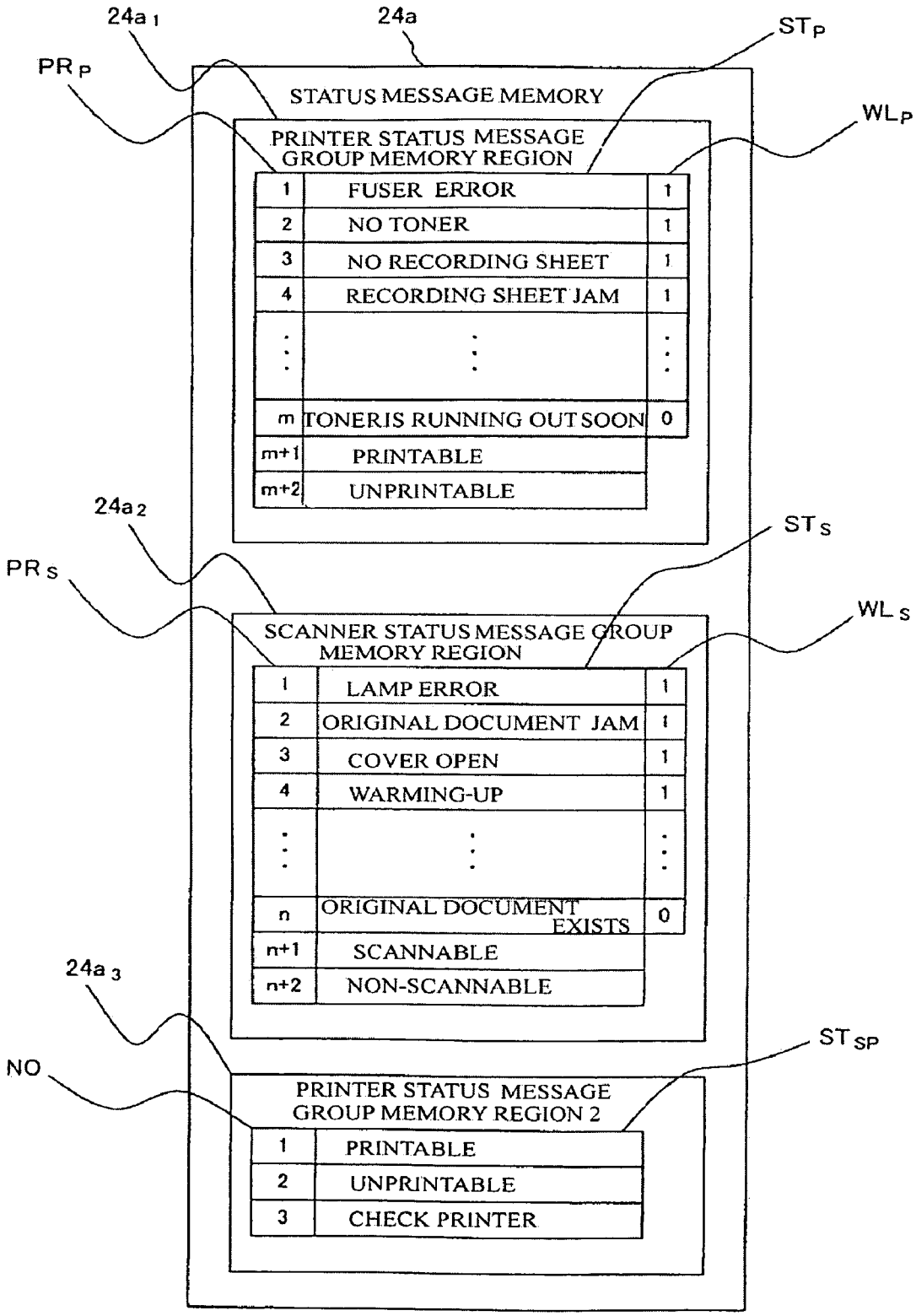
FIG. 10 is a view illustrating an information example to be stored in a status message memory formed in an NVRAM composing a printing apparatus according to the image forming system.

With the image forming system 50 as described above, the printing apparatus 20 is constituted upon forming in the NVRAM 24 the status message memory 24*a* for storing the status message to be displayed on the display units 22*b*, 62*b* for reporting the statuses of the printing apparatus 20 and the scanning apparatus 30, as shown in FIG. 10. This status message memory 24*a* is formed with a scanner status message group memory region $\mathbf{24}a_2$ substantially the same as the above described scanner status message group memory region $\mathbf{24}a_1$ for storing the group of messages for indicating the statuses generated at the scanning unit 63 of the scanning apparatus 60 and a second printer status message group memory region $\mathbf{24}a_3$ substantially the same as the above described printer status message group memory region $\mathbf{34}a_2$ for storing the group of messages for indicating the statuses generated at the printing unit 23, other than the first printer status message group memory region $\mathbf{24}a_1$ for storing the group of messages for indicating the statuses generated at the printing unit 23.

That is, the printing apparatus 20 utilizes as the content displayed on the display unit 22*b* the status message STp stored in the first printer status message group memory region $\mathbf{24}a_1$ whereas utilizing as the content displayed on the display unit 62*b* both the status message STs stored in the scanner status message group memory region $\mathbf{24}a_2$ and the status message STsp stored in the second printer status message group memory region $\mathbf{24}a_3$.

With the image forming system 50, in the event of change in the status of the printing unit 23, the status display operation is implemented to the display unit 22*b* on the operation panel 22 upon implementation of the sequence of operational steps such as shown in FIG. 6 as described above based on the control by the main controller 21, thereby displaying the status such as shown in FIG. 3 as described above. With the image forming system 50, in the event of change in the status of the scanning unit 63, the status display operation is implemented to the display unit 62*b* on the operation panel 62 upon making the sequence of operational steps such as shown in FIG. 7 as described above based on the control by the main controller 21, thereby displaying the status such as shown in FIG. 5 as described above. Furthermore, with the image forming system 50, in the event of change in the content displayed on the printer status message display region $\mathbf{22}b_1$ formed at the display unit 22*b* of the printing apparatus 20, the status display operation is implemented to the display unit 62*b* on the operation panel 62 upon implementation of substantially the same sequent operational steps as those such as shown in FIG. 8 as described above, thereby displaying the status such as shown in FIG. 5 as described above. With the image forming system 50, it is to be noted that it is unnecessary to make an inquiry to the other main controllers to implement the operational steps such as shown in FIG. 8, nor to implement the operation at step S41 since the image forming system 50 has the single main controller.

As described above, the image forming system 50 described as the second embodiment of the invention displays based on the operable level information the status message indicating whether the printing function at the printing apparatus 20 is available or not in addition to the status message of the scanning apparatus 60 on the display unit 62*b* on the operation panel 62 formed to the scanning apparatus 60 to be connected as the option unit in a detachable and attachable manner to the independently operable printing apparatus 20. Consequently, with the image forming system 50, the user having intention of using the copying function can make a judgment so easily as to whether the copying function is presently available or not. Furthermore, it is only necessary to display the status message for indicating whether the printing function at the printing apparatus 20 is available or not as the status message of the printing apparatus 20 to be displayed on the display unit 62*b* on the operation panel 62 formed to the scanning apparatus 60, so that it is unnecessary to form to the scanning apparatus 60 the display region for displaying the status message for indicating whether the printing function at the printing apparatus 20 is available or not, to store all the status messages to be displayed on the display unit 22*b* of the printing apparatus 20 in the scanning apparatus 60, nor to complicate the structure to display the pictorial symbols such as, e.g., icons or the like, corresponding to the statuses respectively, and thus the cost reduction can be intended. Therefore, the image forming system 50 can meet flexibly the specification change for each of those printing apparatus 20 and scanning apparatus 60 without limited by combination of therebetween.

The image forming apparatus as the third embodiment is described next.

The image forming apparatus as the third embodiment is not structured upon connecting the printer apparatus structured as a separated apparatus and the scanning apparatus, not likewise the image forming system 10 described as the first embodiment nor the image forming system 50 described as the second embodiment, but structured as a united apparatus for realizing combined functions of the printing function and the scanning function. In the description for the third embodiment, therefore, substantially the same structures as those in the first and second embodiments are assigned with the same reference numbers as in the first and second embodiments, and for the sake of simplicity, those duplicated descriptions are omitted.

Figure 11:
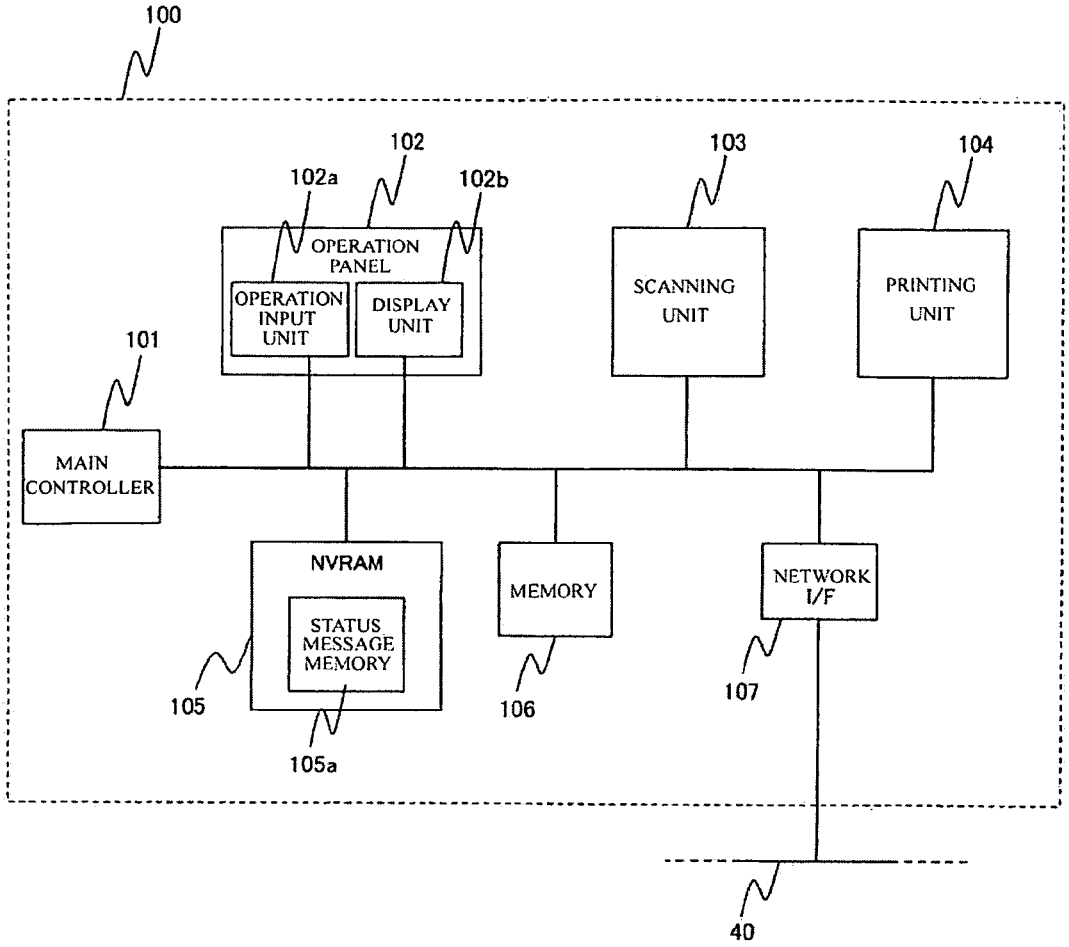
FIG. 11 is a block diagram illustrating a structure of an image forming apparatus according to the third embodiment of this invention.
Figure 12:
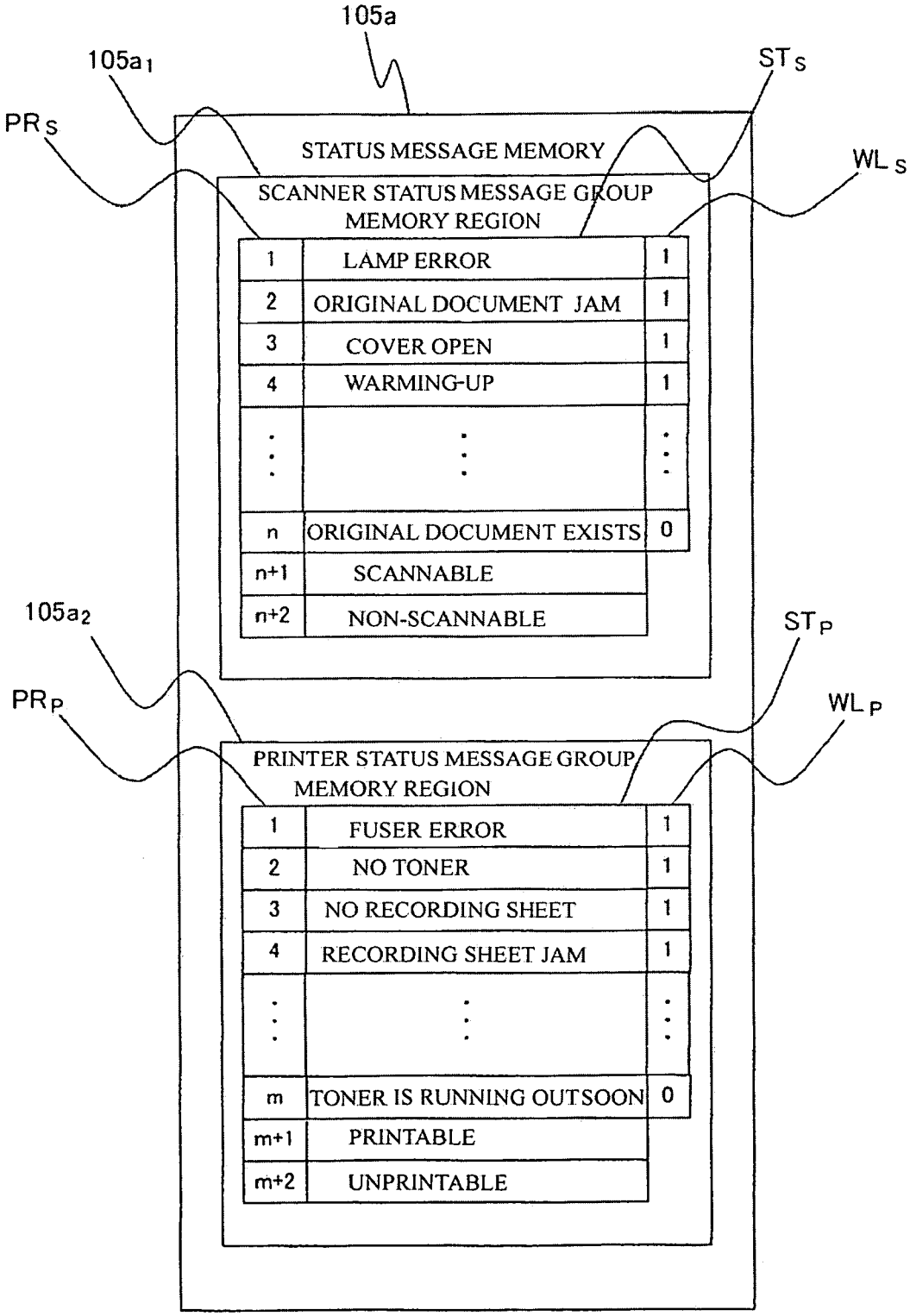
FIG. 12 is a vies illustrating an information example to be stored in a status message memory formed in an NVRAM of the image forming apparatus.

The image forming apparatus described as the third embodiment is composed as shown in FIG. 11. That is, a image forming apparatus 100 has a main controller 101 serving as a controlling section for controlling the printing apparatus 100 comprehensively, an operation panel 102 serving as a user interface for implementing various types of input operation and display, a scanning unit 103 serving as an image reading section for reading optically the image on the original record, a printing unit 104 serving as an image forming section for forming the image, an NVRAM 105 serving as a storing section for storing various programs for controlling the operation of the scanning function, the printing function, and the copying function at the image forming apparatus 100, a memory 106 for storing various information, and a network interface 107 for connecting the image forming apparatus 100 to the network 40 connected to an external apparatus such as, e.g., a host computer, or the like. The operation panel 102 among those has both an operation input unit 102*a* composed of operating elements such as, e.g., various buttons, switches, or the like, for executing the scanning function, the printing function, and the copying function at the image forming apparatus 100 and a display unit 102*b* for displaying various information to be indicated such as, e.g., conditions or operational statuses of those functions, or the like.

The image forming apparatus 100 as described above operates the scanning unit 103 based on the control by the main controller 101 to the read optically the original document image printed on the predetermined recording medium such as, e.g., the recording paper or the like whereas operating the printing unit 104 to form the image on the predetermined recording medium such as, e.g., the recording paper or the like. Furthermore, the printing unit 104 forms on the recording medium such the image data of the image on the original document as read from the predetermined recording sheet so that the image forming apparatus 100 realizes the copying function.

Figure 13:
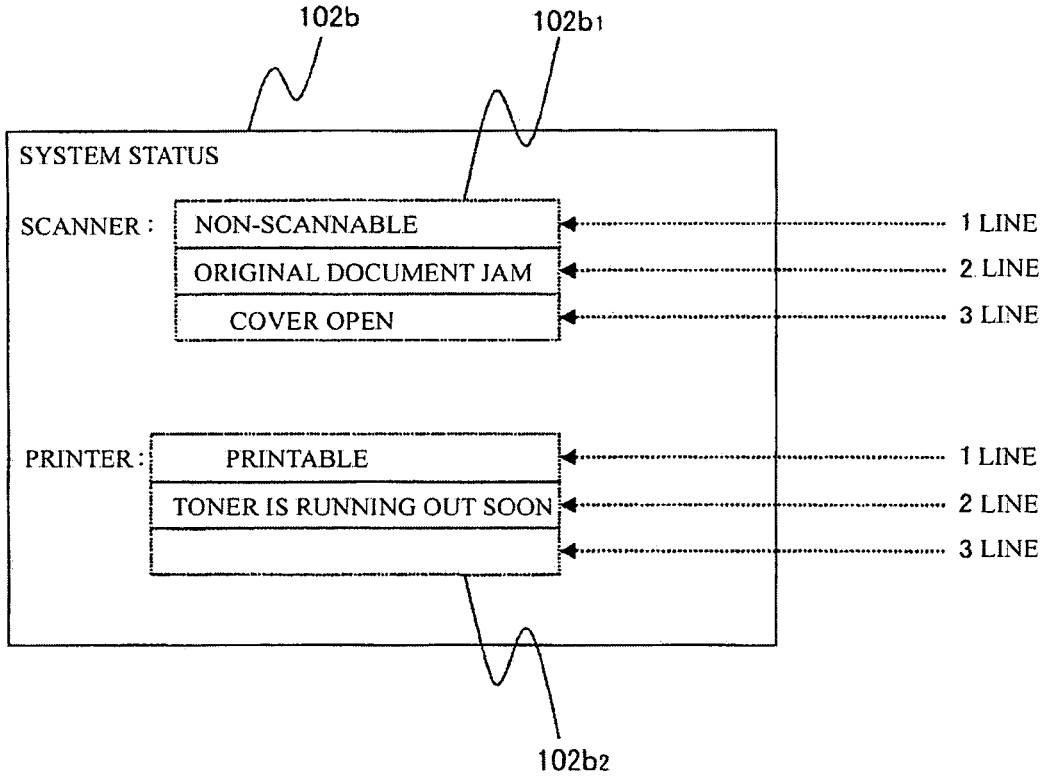
FIG. 13 is a view illustrating a display example on a scanner status message display region and a printer status message display region formed in a display unit of the image forming apparatus.

The image forming apparatus 100 as described above is constituted upon forming in the NVRAM 105 a status message memory 105*a* for storing the status message to be indicated on the display unit 102*b* for reporting the status of the image forming apparatus 100. The status message memory 105*a* is formed with both of a scanner status message group memory region 105$a_1$, substantially the same as the above described scanner status message group memory regions 34$a_1$, 24$a_2$ for storing the group of messages for indicating the statuses generated at the scanning unit 103 and a printer status message group memory region 105$a_2$ substantially the same as the above described printer status message group memory region 24$a_1$ for storing the group of messages for indicating the statuses generated at the printing unit 104. The image forming apparatus 100 reads based on the control by the main controller 101, the status message to be reported from the various status messages STs stored in the scanner status message group memory unit 105$a_1$, thereby displaying the read status message on the scanner status message display region 102$b_1$ formed at the display unit 102*b* on the operation panel 102, as shown in FIG. 13. Furthermore, the image forming apparatus 100 reads based on the control by the main controller 101, the status message to be reported from the various status messages STp stored in the printer status message group memory unit 105$a_2$, thereby displaying the read status message on the printer status message display region 102$b_2$ formed at the display unit 102*b* on the operation panel 102. It is to be noted that FIG. 13 shows a display example in which three status messages are displayable at a maximum with respect to each of the statuses of the scanning unit 103 and the printing unit 104.

With the image forming apparatus 100, in the event of change in the status of the printing unit 104, the status display operation is implemented to the display unit 102*b* on the operation panel 102 upon implementation of the sequence of operational steps such as shown in FIG. 6 as described above based on the control by the main controller 101, thereby displaying the status message STp on the printer status message display region 102$b_2$ as shown in FIG. 13. Furthermore, with the image forming apparatus 100, in the event of change in the status of the scanning unit 103, the status display operation is implemented to the display unit 102*b* on the operation panel 102 upon implementation of the sequence of operational steps such as shown in FIG. 7 as described above based on the control by the main controller 101, thereby displaying the status message STs on the scanner status message display region $\mathbf{102}b_1$ as shown in FIG. 13. It is to be noted that FIG. 13 shows a display example on the scanner status message display region $\mathbf{102}b_1$, in which the message for indicating "the original document readable status" is displayed on the first line, and in which the message having the priority PSs equal to "two" and the warning level WLs equal to "one" for indicating the status that "the original document gets jammed" is displayed in the second line, and in which the message having the priority PRs equal to "three" and the warning level WLs equal to "one" for indicating the status that "the original document board stacked with the original document is open" is displayed in the third line. FIG. 13 furthermore shows a display example on the printer status message display region $\mathbf{102}b_2$, in which the message for indicating the "printable" status is displayed in the first line, and in which the message having the priority PRp of "m" and the warning level WLp equal to "zero" for indicating the status that "the toners are running out" is displayed in the second line.

As described above, the image forming apparatus 100 as the third embodiment divides the status information into groups by function and displays by function the status in one or plural number on the display unit 102*b* according to the order of priority. With image forming apparatus 100, therefore, such a case is never occurred that displayed is undesirably only the contents partial to a specific function but the status indication for the other functions. With the image forming apparatus 100, the user can make a judgment so easily as to availability for each function based on the warning level corresponding to the status message displayed on the display unit 102*b*.

Finally, the image forming apparatus as the fourth embodiment is described.

In the description for the fourth embodiment, substantially the same structures as those in the first, second, and third embodiments are assigned with the same reference numbers as in those embodiments, and for the sake of and for the sake of simplicity, those duplicated descriptions are omitted.

Figure 14:
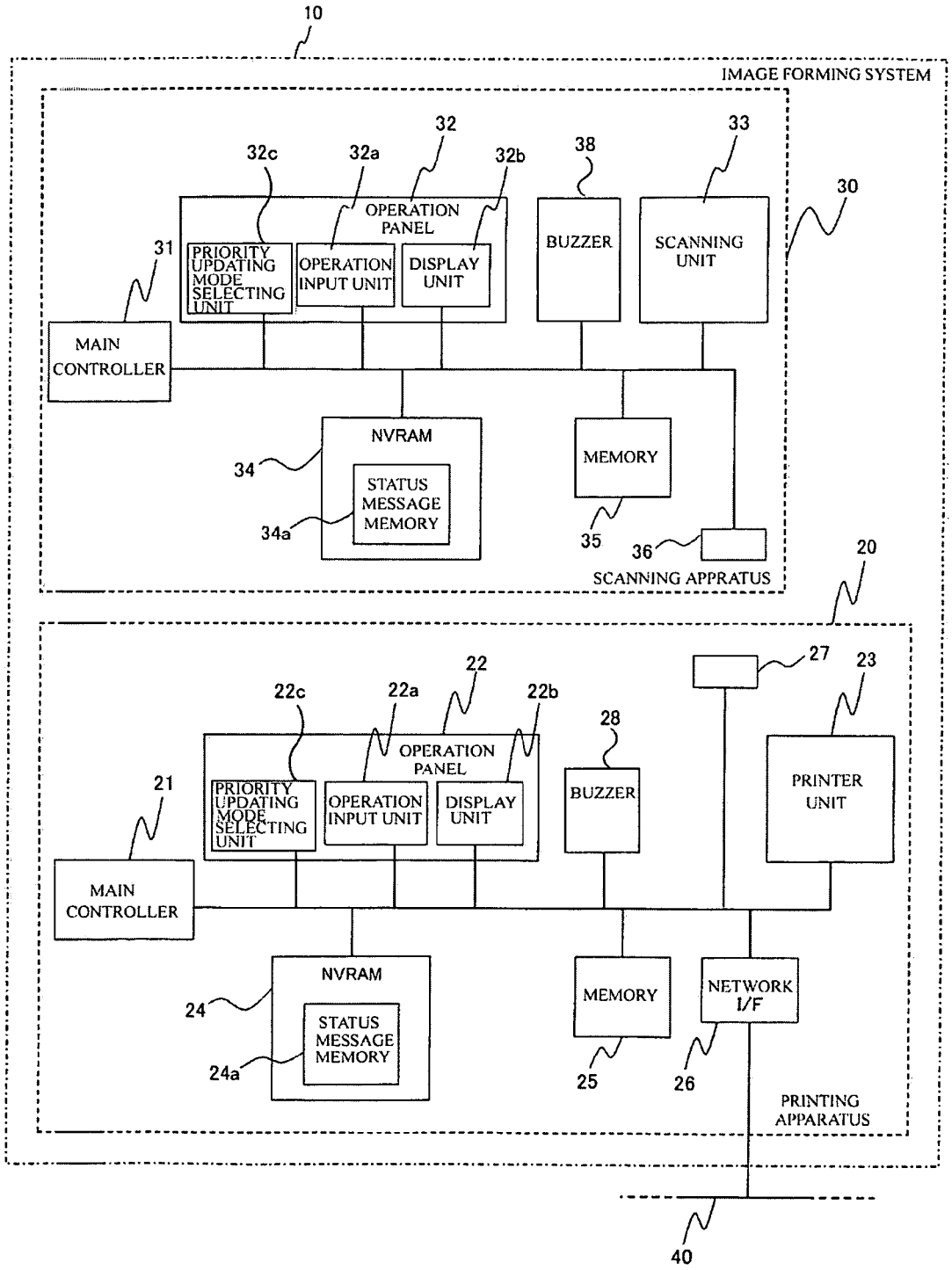
FIG. 14 is a block diagram illustrating a structure of an image forming system according to the fourth embodiment of this invention.

The image forming apparatus described as the firth embodiment is composed as shown in FIG. 14. One part different from the structure of the first embodiment is that the operation panel is further formed with a priority updating mode selecting unit for selecting a mode for updating the priority of the status message. The priority updating mode selecting unit is composed of a printer message priority updating mode selecting unit 22*c* and a scanner message priority updating mode selecting unit 32*c*. The other different part is that the printing unit is formed with a buzzer 28 whereas the scanning unit is formed with a buzzer 38. The buzzers 28, 38 notify audibly the user about the unavailable status whereas the display unit displays the unavailable status in a case where a judgment is made that each of the printing unit and the scanning unit cannot operate normally.

The operational flow is substantially the same as that in the first embodiment, but different parts are that the user selects both the status message updating modes of the printing unit and the scanning unit before operation and that the buzzers notify audibly the user about the unavailable status whereas the display unit displays the unavailable status in a case where a judgment is made that each of the printing unit and the scanning unit cannot operate normally.

Figures 17, 18:
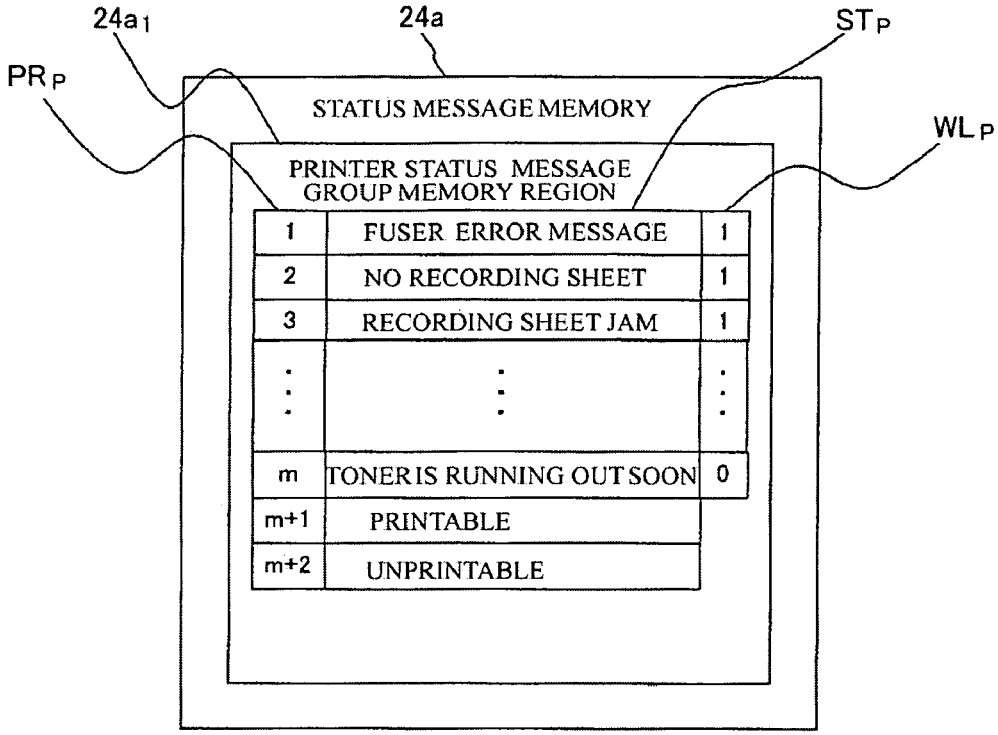
FIG. 17 is a view illustrating information example to be stored in a status message memory formed in an NVRAM composing a printing apparatus according to the image forming system.
FIG. 18 is a view illustrating an example of a coordination between a printer status message and an updating time interval according to the image forming system.

Herein, the status message updating mode of the printing unit is explained as an example of this embodiment. When the user presses an updating button on the printer status message updating mode selecting unit 22*c*, a screen as shown in FIG. 15 is displayed. At this time, the mode for updating the priority of the printer status message is selected between an immediate interruption mode #1 and an interruption with a predetermined waiting time mode #2. Where the user selects the immediate interruption mode #1 in the event of "no toner" status where the printer status message is such as shown in FIG. 17 at some point, for example, the main controller 21 updates the priority of each status message stored in the printer status message group memory region as shown in FIG. 2 to display the message indicating "no toner" status. On the other hand, where the user selects the interruption with a predetermined waiting time mode #2, the main controller 21 updates the priority of each status message in reference to an updating time corresponding to each printer status message previously set, such as shown in FIG. 17. For example, where the printer status massage is such as shown in FIG. 17 at some point, since the updating time interval for "no toner" message shown in FIG. 18 is set to 2s, the main controller 21 does not update immediately the priority of each message stored in the printer status message group memory region but updates for the first time each of the priorities of messages stored in the printer status message group memory region to the priorities as shown in FIG. 2 after the interval of 2s passes.

In FIG. 18, an updating time period 10s corresponding to the message indicating the status that "the toners is running out soon" is set longer than the updating time period 2s corresponding to "no toner" message. This is because the printing operation can be implemented normally even where the waiting time is prolonged not to implement the updating operation in the event of the message indicating the status that "the toner is running out soon". In FIG. 18, the updating time interval corresponding to the fuser error is set to 0s. Therefore, the updating operation is implemented immediately even where the priority updating mode is in the interruption with a predetermined waiting time mode #2 when the error is occurred during the operation of the fuser. The updating time interval corresponding to the scanner status message is shown in FIG. 19. In FIG. 19, the updating time interval corresponding to a lamp error is set to 0s. Thus, the updating operation can be implemented immediately even in the interruption with a predetermined waiting time mode #2 where the error is caused during the operation of the lamp. FIG. 19 shows a priority updating time interval corresponding to the scanner status message. In FIG. 19, the updating time interval corresponding to the fuser error is set to 0s. That is, the updating operation is immediately implemented even where the priority updating mode is in the interruption with a predetermined waiting time mode #2 in the event of the lamp error.

The priority updating mode of the scanner status message is set as described above in the scanning unit. Substantially the same operational flow as in the first embodiment is implemented subsequently. However, where the printing unit enters in the "unprintable" mode as shown in FIG. 3 during the operation, the display unit displays the unprintable status to the user visually while the buzzer unit 28 notifies the user about the unprintable status audibly. Where the scanning unit enters in the "unreadable" mode, the display unit also displays the unreadable status to the user visually while the buzzer unit 38 notifies the user about the unreadable status audibly.

In addition to the effects of the first embodiment, this embodiment has the effect that usability of this system can be improved for the user upon setting with the priority updating selecting mode the status message priority of each of the printing unit and the scanning unit depending on the use environment. Furthermore, the usage can be further improved upon displaying the unavailable status on the display unit to the user visually and upon notifying the unavailable status to the user audibly using the buzzer unit 38 audibly in a case of both the printing unit and the scanning unit in the unavailable mode.

In this embodiment, both the status message priority updating mode selecting units of the printing unit and the scanning unit and the buzzer unit are added to the structure of the first embodiment but can be added to that of the second embodiment for carrying out this invention.

It is to be noted that this invention is not limited to the above described embodiments. In description for those embodiments, for example, two values, i.e., "zero" and "one" are used as the warning level corresponding to the status message of the printing apparatus to display at the scanning apparatus the status indicating whether the printing apparatus is available or not, but the third level warning level may be set to indicate such the status of the printing apparatus as possibly resulting in quality deterioration in the formed image, for example, the status that "the toners are running out", or that "a life of a photosensitive drum is expiring", and the information of those statuses may be reported to the scanning apparatus to display the status such as, e.g., "printable status (warning-image quality) as the status having the third warning level of the printing apparatus on the display unit of the scanning apparatus.

Furthermore, in the description for those embodiments, each display unit is formed with the display region in the plurality of lines, but this invention is not limited to the above display forms and the display region in an arbitrary form.

As described above, it is obvious that this invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming system including an image processing apparatus having a function of reading optically an image on an original document, and an image forming apparatus having a function of forming an image on a predetermined recording medium, said image forming apparatus comprising:

a first display section for displaying image forming status information data indicating a status of said image forming apparatus;

a first storage section for storing corresponding to each other said plurality of image forming status information data and operable level information used for selecting said image forming status information to be displayed on said first display section among said plurality of image forming status information data;

a first interface for connecting said image forming apparatus to said image processing apparatus;

an image forming section for forming image data received from said image processing apparatus through said first interface section on said recording medium; and a first controller for selecting, based on said status of said image forming apparatus and said operable level information stored in said first storage section, said image forming status information data to be displayed on said first display section among said plurality of image forming status information data stored in said first storage section, and said image processing apparatus comprising:

a second display section for displaying image processing status information data indicating a status of said image processing apparatus;

a second storage section for storing corresponding to each other said plurality of image processing status information data and said operable level information used for selecting said image processing status information data to be displayed on said second display section among said plurality of image processing status information data;

a third storage section for storing said image forming status information data corresponding to said operable level information of said image forming apparatus;

a third display section for displaying said image forming status information data stored in said third storage section;

a second interface section for connecting said image processing apparatus to said image forming apparatus;

an image reading section for reading said image and for transmitting retrieved image data to said image forming apparatus through said second interface section;

an operable level information retrieving section for retrieving said operable level information of said image forming apparatus; and a second controller for selecting based on said status of said image processing apparatus and said operable level information stored in said second storage section said image processing status information data to be displayed on said second display section among said plurality image processing status information data stored in said second storage section, and for selecting based on said operable level information of said image forming apparatus retrieved with said operable level information retrieving section said image forming status information data to be displayed on said third display section among said plurality of image forming status information data stored in said third storage section.

2. The image forming system according to claim 1, wherein at least one of said image forming apparatus and said image processing apparatus has a priority setting section for setting a priority of said operable level information.

3. The image forming system according to claim 1, wherein an unavailable status is notified audibly in a case where at least one of said image forming apparatus and said image processing apparatus is in said unavailable state.

4. The image forming system according to claim 1, wherein said operable level information includes a parameter indicating a priority order reporting to a user about said plural statuses generated at either or both of said image forming apparatus and said image processing apparatus.

5. The image forming system according to claim 4, wherein said operable level information includes a parameter indicating whether said function of either or both of said image forming apparatus and said image processing apparatus is available or not in a case of an occurrence of said corresponding status.

6. The image forming system according to claim 1, wherein said third display section displays said image forming status information data indicating at least whether said function of said image forming apparatus is available or not.

7. The image forming system according to claim 1, wherein said image forming apparatus and said image processing apparatus are respectively formed as independently operable apparatuses.

8. An image processing apparatus having a function of reading optically an image on an original document comprising:

a first display section for displaying image processing status information data indicating a status of said image processing apparatus;

a first storage section for storing corresponding to each other said plurality of image processing status information data and operable level information used for selecting said image processing status information data to be displayed on said first display section among said plurality of image processing status information data;

an interface section for connecting said image processing apparatus to an image forming apparatus having a function of forming an image on a predetermined recording medium;

an image reading section for reading said image and for transmitting retrieved image data to said image forming apparatus through said interface section;

a second storage section for storing image forming status information data corresponding to said operable level information used for selecting said image forming status information data to be displayed on a display section of said image forming system among said plurality of image forming status information data indicating the status of said image forming apparatus connected through said interface section;

a second display section for displaying said image forming status information data stored in said second storage section;

an operable level information retrieving section for retrieving said operable level information of said image forming apparatus; and a controller for selecting, based on said status of said image processing apparatus and said operable level information stored in said first storage section, said image processing status information data to be displayed on said first display section among said plurality of image processing status information data stored said first storage section and for selecting, based on said operable level information of said image forming apparatus retrieved with said operable level information retrieving section, said image forming status information data to be displayed on said second display section among said plurality of image forming status information data stored in said second storage section.

9. An image forming system including an image processing apparatus having a function of reading optically an image on an original document, and an image forming apparatus having a function of forming said image on a predetermined recording medium, said image forming apparatus comprising:

a first display section for displaying image forming status information data indicating a status of said image forming apparatus;

a first storage section for storing corresponding to each other said plurality of image forming status information data and operable level information used for selecting said image forming status information data to be displayed on said first display section among said plurality of image forming status information data;

a second storage section for storing corresponding to each other a plurality of image processing status information data indicating a status of said image processing apparatus and said operable level information used for selecting among said plurality of image processing status information data said image processing status information data to be displayed on a display section of said image processing apparatus;

a third storage section for storing said image forming status information data corresponding to said operable level information of said image forming apparatus;

a first interface section for connecting said image forming apparatus to said image processing apparatus;

an image forming section for forming on said recording medium image data received from said image processing apparatus through said first interface section;

an image processing apparatus status retrieving section for retrieving said status of said image processing apparatus from said image processing apparatus through said first interface section; and a controller for selecting, based on said status of said image forming apparatus and said operable level information stored in said first storage section, said image forming status information data to be displayed on a first display section among said plurality of image forming status information data stored in said first storage section, and said image processing apparatus comprising:

a second display section for displaying said image processing status information data indicating said status of said image processing apparatus;

a second interface section for connecting said image processing apparatus to said image forming apparatus;

an image reading section for reading said image and for transmitting retrieved image data to said image forming apparatus through said second interface section; and a third display section for displaying said image forming status information data stored in said third storage section, wherein said controller selects, based on said status of said image processing apparatus retrieved with said image processing apparatus status retrieving section and said operable level information stored in said second storage section, said image processing status information data to be displayed on said second display section among said plurality of image processing status information data stored in said second storage section, and selects, based on said operable level information stored in said first storage section, said image forming status information data to be displayed on said third display section among said plurality of image forming status information data stored in a third storage section.

10. The image forming system according to claim 9, wherein at least one of said image forming apparatus and said image processing apparatus has a priority setting section for setting a priority of said operable level information.

11. The image forming system according to claim 9, wherein an unavailable status is notified audibly in a case where at least one of said image forming apparatus and said image processing apparatus is in said unavailable status.

12. The image forming system according to claim 9, wherein said image processing apparatus is formed as an independently inoperable apparatus connected in a detachably attachable manner to said independently operable image forming apparatus.

13. An image forming apparatus having a function of forming an image on a predetermined recording medium comprising:

a display section for displaying image forming status information data indicating a status of said image forming apparatus;

a first storage section for storing corresponding to each other said plurality of image forming status information data and operable level information used for selecting said image forming status information data to be displayed said display section among said plurality of image forming status information data;

a first interface section for connecting said image forming apparatus to an image processing apparatus having a function of reading optically an image on an original document;

an image forming section for forming on said recording medium image data received from said image processing apparatus through said first interface section;

an image processing apparatus status retrieving section for retrieving a status of said image processing apparatus from said image processing apparatus through said first interface section;

a second storage section for storing corresponding to each other said plurality of image processing status information data indicating said status of said image processing apparatus connected through said interface section and said operable level information used for selecting among said plurality of image processing status information data said image processing status information data to be displayed on a display section of said image processing apparatus;

a third storage section for storing said image forming status information data corresponding to said operable level information of said image forming apparatus; and a controller for selecting, based on said status of said image forming apparatus and said operable level information stored in said first storage section, said image forming status information data to be displayed on said display section of said image forming apparatus among said plurality of image forming status information data stored in said first storing section, and for selecting, based on said status of said image processing apparatus retrieved with said image processing apparatus status retrieving section and said operable level information stored in said second storage section, said image processing status information data to be displayed on said display section of said image processing apparatus among said plurality of image processing status information data stored in said second storage section, and for selecting, based on said operable level information stored in said first storage section, said image forming status information data to be displayed on said display section of said image processing apparatus among said plurality of image forming status information data stored in said third storage section.

14. An image forming apparatus comprising:

an image forming section for forming an image on a predetermined recording medium;

an image reading section for reading optically an image on an original document;

a first display section for displaying image forming status information data indicating a status of said image forming section;

a first storage section for storing corresponding to each other said plurality of image forming status information data and operable level information used for selecting said image forming status information data to be displayed on said first display section among said plurality of image forming status information data;

a second display section for displaying image processing status information data indicating a status of said image reading section;

a second storage section for storing corresponding to each other said plurality of image processing status information data and said operable level information used for selecting said image processing status information data to be displayed on said second display section among said plurality of image processing status information data; and a controller for selecting, based on said status of said image forming section and said operable level information stored in said first storage section, said image forming status information data to be displayed on said first display section among said plurality of image forming status information data stored in said first storage section, and for selecting, based on said status of said image reading section and said operable level information stored in said second storage section, said image processing status information data to be displayed on said second display section among said plurality of image processing status information data stored in said second storage section.

* * * * *